US009242811B2

(12) United States Patent
Kotaka

(10) Patent No.: US 9,242,811 B2
(45) Date of Patent: Jan. 26, 2016

(54) MEDIUM MOUNTING MECHANISM AND RECORDING APPARATUS

(71) Applicant: SEIKO EPSON CORPORATION, Tokyo (JP)

(72) Inventor: Toshikazu Kotaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/486,445

(22) Filed: Sep. 15, 2014

(65) Prior Publication Data

US 2015/0084274 A1 Mar. 26, 2015

(30) Foreign Application Priority Data

Sep. 24, 2013 (JP) ..... 2013-196561

(51) Int. Cl.
*B65H 1/04* (2006.01)
*B65H 1/26* (2006.01)

(52) U.S. Cl.
CPC ..... *B65H 1/04* (2013.01); *B65H 1/266* (2013.01); *B65H 2301/4222* (2013.01); *B65H 2405/1142* (2013.01); *B65H 2511/12* (2013.01); *B65H 2701/1131* (2013.01)

(58) Field of Classification Search
CPC ..... B65H 1/00; B65H 1/04; B65H 31/20; B65H 2405/10; B65H 2405/111; B65H 2405/1142; B65H 2405/1122; B65H 2301/4222; B65H 2511/12; B65H 2701/1131
See application file for complete search history.

(56) References Cited

U.S. PATENT DOCUMENTS

| | | | | |
|---|---|---|---|---|
| 7,469,893 | B2 * | 12/2008 | Yamada | 271/171 |
| 7,854,427 | B2 * | 12/2010 | Tsujinishi | 271/171 |
| 7,980,555 | B2 * | 7/2011 | Asada et al. | 271/171 |
| 8,430,398 | B2 * | 4/2013 | Kamichi | 271/171 |
| 8,496,243 | B2 * | 7/2013 | Nishioka | 271/171 |

FOREIGN PATENT DOCUMENTS

| | | | |
|---|---|---|---|
| JP | 2002255361 A | * | 9/2002 |
| JP | 2009-073573 | | 4/2009 |
| JP | 2009-073575 | | 4/2009 |

* cited by examiner

*Primary Examiner* — Ernesto Suarez
(74) *Attorney, Agent, or Firm* — Workman Nydegger

(57) ABSTRACT

A sheet cassette includes a cassette main body which forms a sheet accommodating region; an edge guide which is slidable to a position corresponding to a size of a medium; a guide groove which extends along a sliding direction of the edge guide and guides the edge guide in the sliding direction, and into which a portion of the edge guide is inserted; and a widening allowance groove which is provided with a predetermined distance from the guide groove, and allows widening of the guide groove when a portion of the edge guide is inserted into the guide groove.

5 Claims, 25 Drawing Sheets

MEDIUM MOUNTING MECHANISM AND RECORDING APPARATUS

BACKGROUND

1. Technical Field

The present invention relates to a medium mounting mechanism mounting a medium and a recording apparatus including thereof.

2. Related Art

In a recording apparatus exemplified by a facsimile, a printer or the like, a sheet cassette which accommodates a recording sheet as a recording medium, a sheet feed tray provided at a rear portion of an apparatus, an automatic document feeder (ADF) in a scanner or the like is provided with an edge guide which regulates an edge of a sheet. The edge guide is provided to be slidable in a width direction, a length direction or the like of a sheet. The edge guide is positioned to an optimal position corresponding to a size of a sheet by a user and regulates the edge of the sheet at the position (JP-A-2009-73573 and JP-A-2009-73575).

The edge guide is guided by a guide groove formed on a bottom surface of a cassette. That is, a portion of the edge guide is inserted into the guide groove and accordingly the edge guide is guided by the guide groove.

Here, in order to prevent the edge guide from falling out, various structures may be employed in which a leading end of the portion of the edge guide being inserted into the guide groove (hereinafter, the portion is referred to as "insertion portion") is formed to be wider than the width of the guide groove, the guide groove is deformed in a widening direction to have the insertion portion inserted therein, and the insertion portion is engaged with the back surface of the cassette.

Here, considering the easiness of the insertion of the insertion portion into the guide groove, it is preferable that the width of the insertion portion be slightly wider than the guide groove. In this case, however, a catch amount after the insertion becomes small, and thus the insertion portion may easily fall out. On the other hand, when the width of the insertion portion is excessively wider than the guide groove, the insertion property is degraded and, depending on the case, the guide groove or the insertion portion may be damaged.

SUMMARY

An advantage of some aspects of the invention is that it provides a medium mounting mechanism having a configuration in which an installation property of the edge guide is favorable and the edge guide is reliably held (without falling out) even after installation.

According to an aspect of the invention, there is provided a medium mounting mechanism including a main body which forms a medium mounting surface for mounting a medium; an edge guide which guides an edge of the medium mounted on the main body, and is slidable to a position corresponding to a size of the medium; a guide groove which extends along a sliding direction of the edge guide and guides the edge guide in the sliding direction, and into which a portion of the edge guide is inserted; and a widening allowance groove which is provided with a predetermined distance from the guide groove, and allows widening of the guide groove when a portion of the edge guide is inserted into the guide groove.

In this case, since a portion of the edge guide (hereinafter, which will be continuously referred to as "insertion portion") is positioned with a predetermined distance from the insertion guide groove, and a widening allowance groove which allows widening of the guide groove is formed, the insertion portion can be easily inserted into the guide groove (the guide groove can easily widen). In addition, even though the width of the guide groove returns to the original width after insertion, it is possible to prevent the insertion portion, that is, the edge guide from easily falling out. In this manner, the installation property becomes favorable and the edge guide is reliably held even after installation.

In the medium mounting mechanism, the guide groove may include a widening portion for insertion of a portion of the edge guide formed to be wider than the guide groove, and the widening allowance groove may be formed along an extending direction of the guide groove, in the form of including the widening portion in the extending direction of the guide groove.

In this case, the widening allowance groove is formed along an extending direction of the guide groove, in the form of including the widening portion for insertion of a portion of the edge guide (insertion portion) formed in the guide groove. Therefore, when the insertion portion is inserted, the widening portion can favorably widen and thus the insertion portion can be easily inserted.

In the medium mounting mechanism, the edge guide may include a first edge guide which guides an edge on one side of the medium and a second edge guide which guides an edge on the other side of the medium in a medium width direction intersecting with a medium sending-out direction. In the medium sending-out direction, the widening allowance groove with respect to the first edge guide and the widening allowance groove with respect to the second edge guide may be positioned between the guide groove with respect to the first edge guide and the guide groove with respect to the second edge guide.

In this case, in the configuration including a first edge guide and a second edge guide, since the widening allowance groove is positioned between two guide grooves in the medium sending-out direction, when forming the widening allowance groove, it is not necessary to secure a large region for forming the widening allowance groove.

The medium mounting mechanism may further include a closing unit which closes at least a portion of the widening allowance groove.

In this case, since the closing unit which closes at least a portion of the widening allowance groove is provided, after a portion of the edge guide (insertion portion) is inserted into the guide groove, it is difficult for the guide groove to widen, that is, it is difficult for the insertion portion to fall out from the guide groove, and thus the edge guide can be more reliably held.

In the medium mounting mechanism, the closing unit may be configured to include a protrusion formed in a cover member provided in a back surface which is a surface opposite to a bottom surface of an accommodating region in the main body, and the protrusion may close at least a portion of the widening allowance groove by attaching the cover member to the main body.

In this case, since the closing unit is formed in a cover member provided in the back surface of the main body, it is possible to simplify the structure of the closing unit, thereby configuring the closing unit at a low cost.

In the medium mounting mechanism, the edge guide may include a first edge guide which guides an edge on one side of the medium and a second edge guide which guides an edge on the other side of the medium in a medium width direction intersecting with a medium sending-out direction. A protrusion which closes at least a portion of the widening allowance groove may be provided in a cover member provided in a back surface which is a surface opposite to a bottom surface of an accommodating region in the main body. The cover member may be attached to the main body and thereby covers a rack and pinion mechanism which is provided in the back surface and operates the first edge guide and the second edge guide in an interlocking manner.

In this case, since a protrusion which closes at least a portion of the widening allowance groove is provided, after a portion of the edge guide (insertion portion) is inserted into the guide groove, it is difficult for the guide groove to widen, that is, it is difficult for the insertion portion to fall out from the guide groove, and thus the edge guide can be more reliably held. In addition, since the protrusion is provided in a cover member which covers the rack and pinion mechanism, it is possible to obtain the protrusion at a low cost.

In the medium mounting mechanism, the rack and pinion mechanism may include a rack connected to each of the first edge guide and the second edge guide, and a pinion gear engaging with the rack.

In this case, since the rack and pinion mechanism is configured to include a rack connected to each of the first edge guide and the second edge guide, and a pinion gear engaging with the rack, that is, the rack and the edge guide are connected in a separately configured manner, the installation property is enhanced compared to a configuration in which the rack and the edge guide are integrally formed.

According to another aspect of the invention, there is provided a recording apparatus including a recording unit which performs recording on a medium; and the above-described medium mounting mechanism.

In this case, it is possible for the recording apparatus to obtain the same effects as the above-described.

BRIEF DESCRIPTION OF THE DRAWINGS

The invention will be described with reference to the accompanying drawings, wherein like numbers reference like elements.

FIGS. 16A, 16B, and 16C illustrate a change in a state when an insertion portion is inserted into the guide groove.

FIGS. 17A, 17B, and 17C illustrate a change in a state when the insertion portion is inserted into the guide groove.

FIGS. 18A, 18B, and 18C illustrate a change in a state when the insertion portion is inserted into the guide groove.

FIG. 25A is a view illustrating a state before attaching a first spacer, and FIG. 25B is a view illustrating a state after attaching the first spacer.

DESCRIPTION OF EXEMPLARY EMBODIMENTS

Hereinafter, an embodiment of the invention will be described with reference to drawings, but the invention is not limited to the embodiment to be described below and various modifications may be possible within the scope of the invention claimed in claims. The following embodiment of the invention will be described on the premise that the modifications are also within the scope of the invention.

Figure 1:
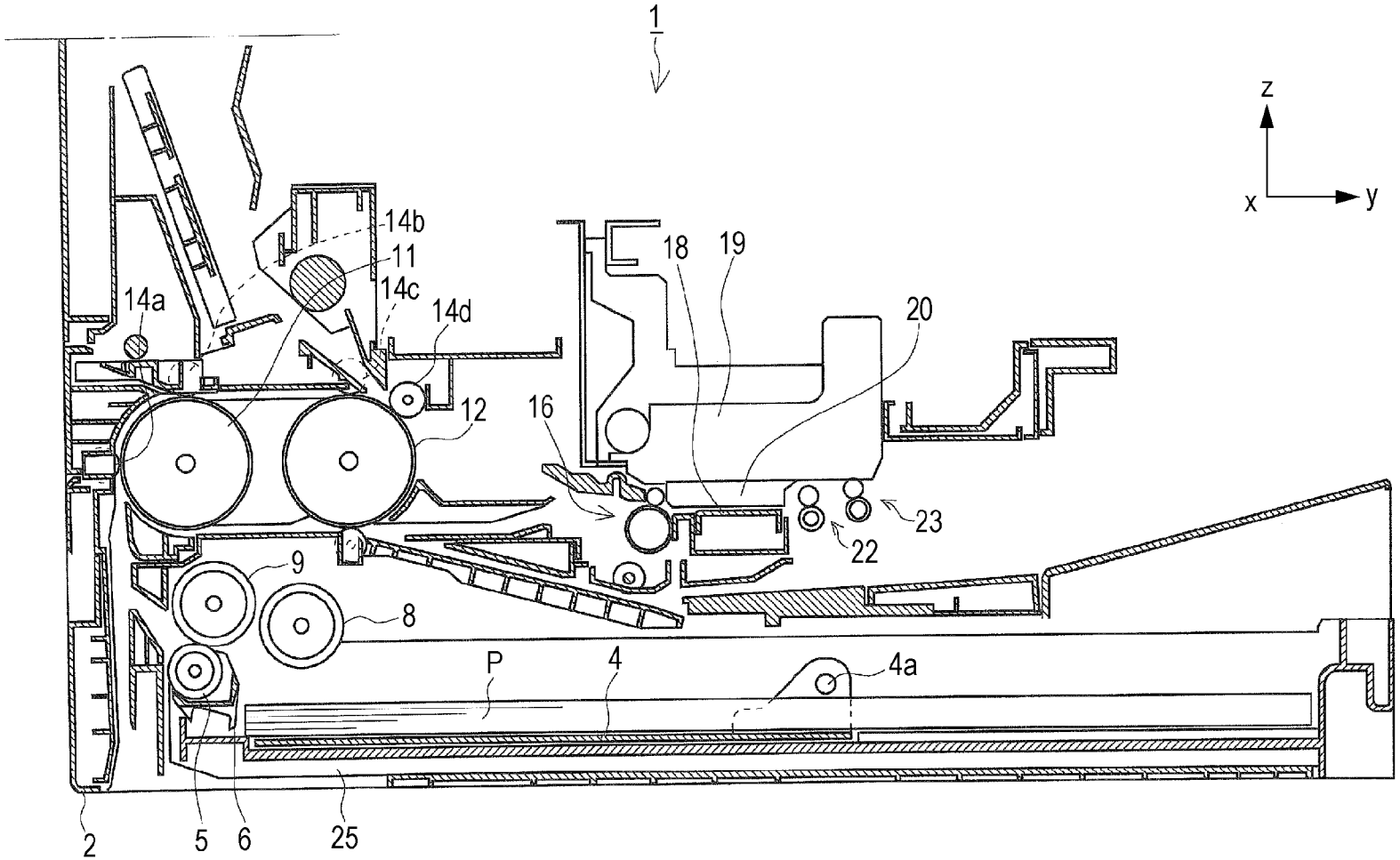
FIG. 1 is a side cross-sectional view illustrating a sheet transporting path of a printer according to the invention.
Figure 2:
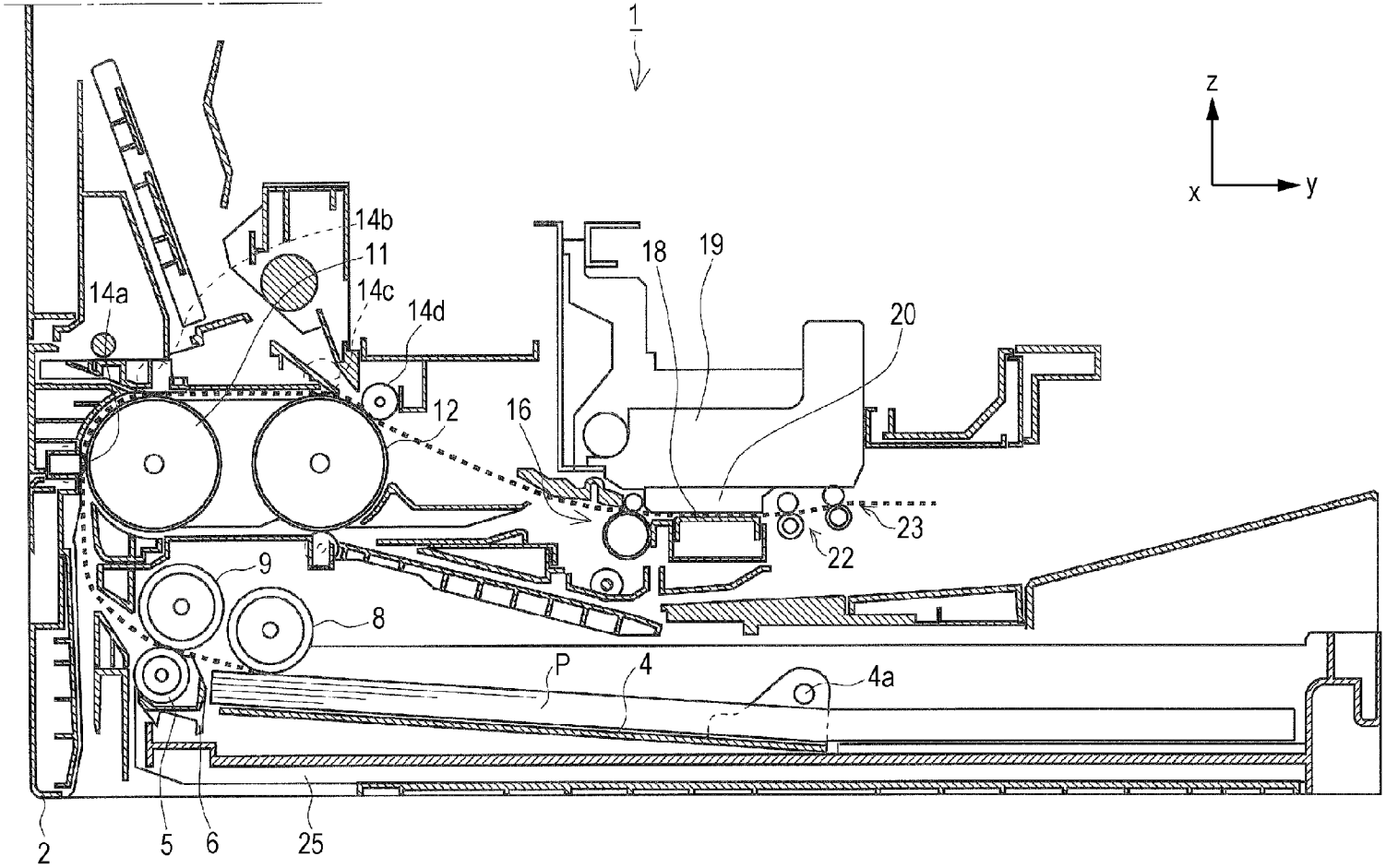
FIG. 2 is a side cross-sectional view illustrating the sheet transporting path of the printer according to the invention.
Figure 3:
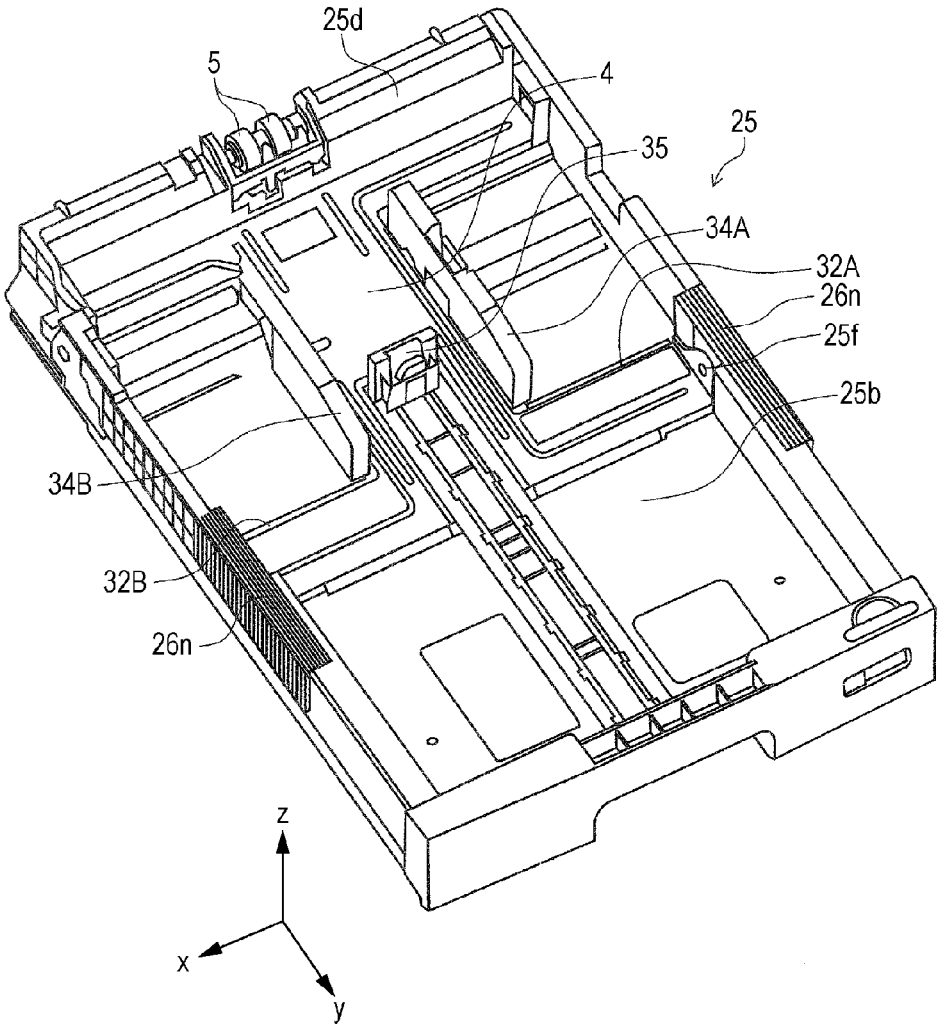
FIG. 3 is a perspective view of a sheet cassette according to the invention seen from the face.
Figure 4:
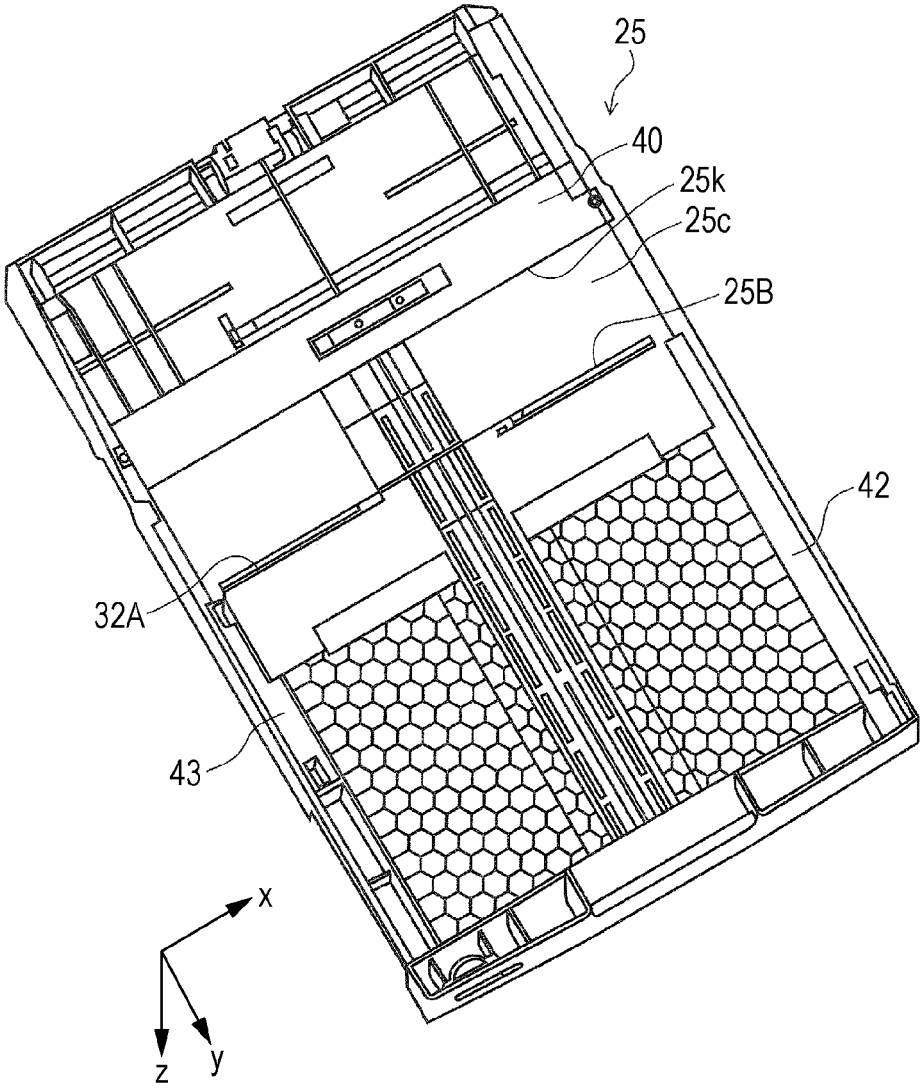
FIG. 4 is a perspective view of the sheet cassette according to the invention seen from the back.
Figure 5:
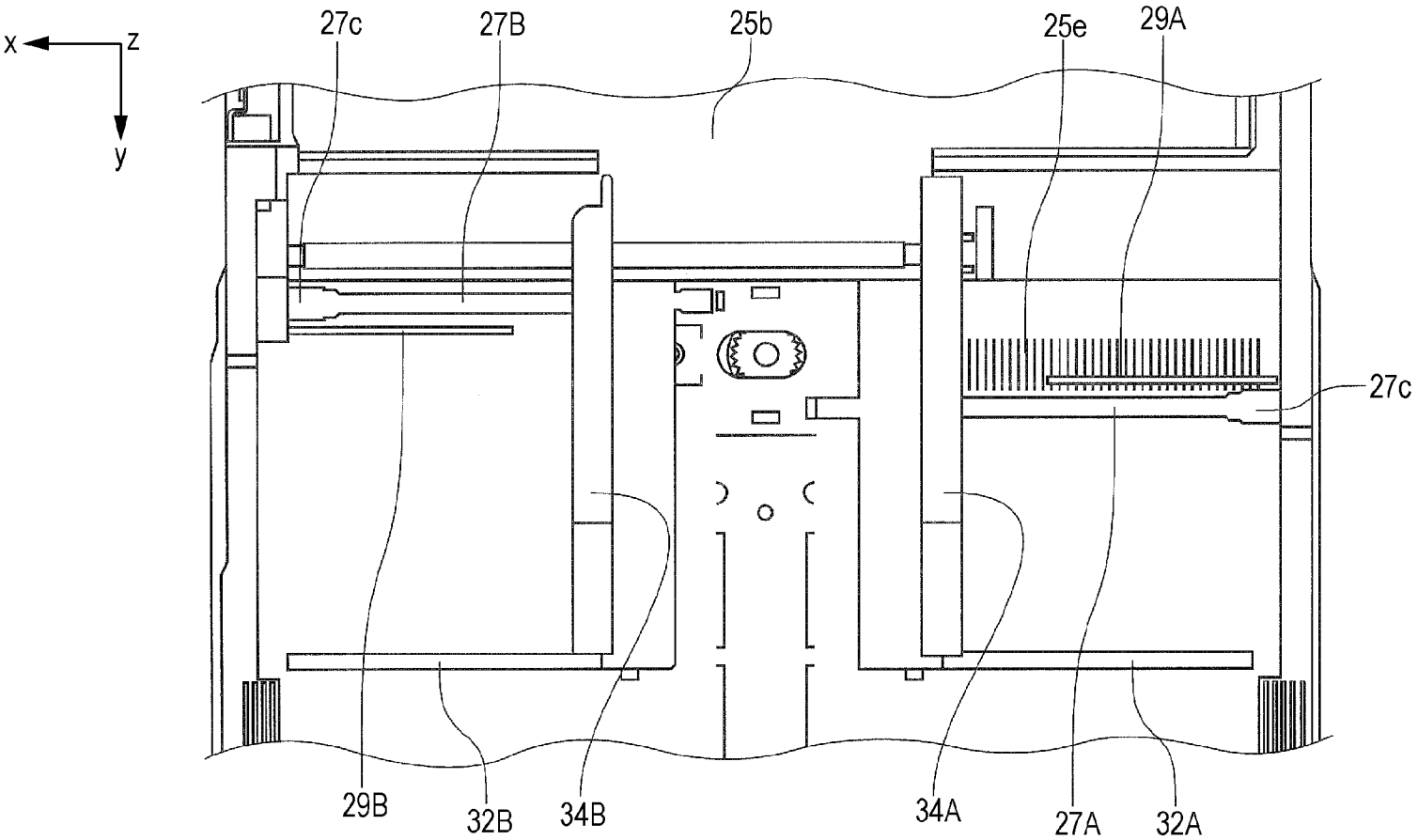
FIG. 5 is an enlarged plan view of the face of the sheet cassette according to the invention.
Figure 6:
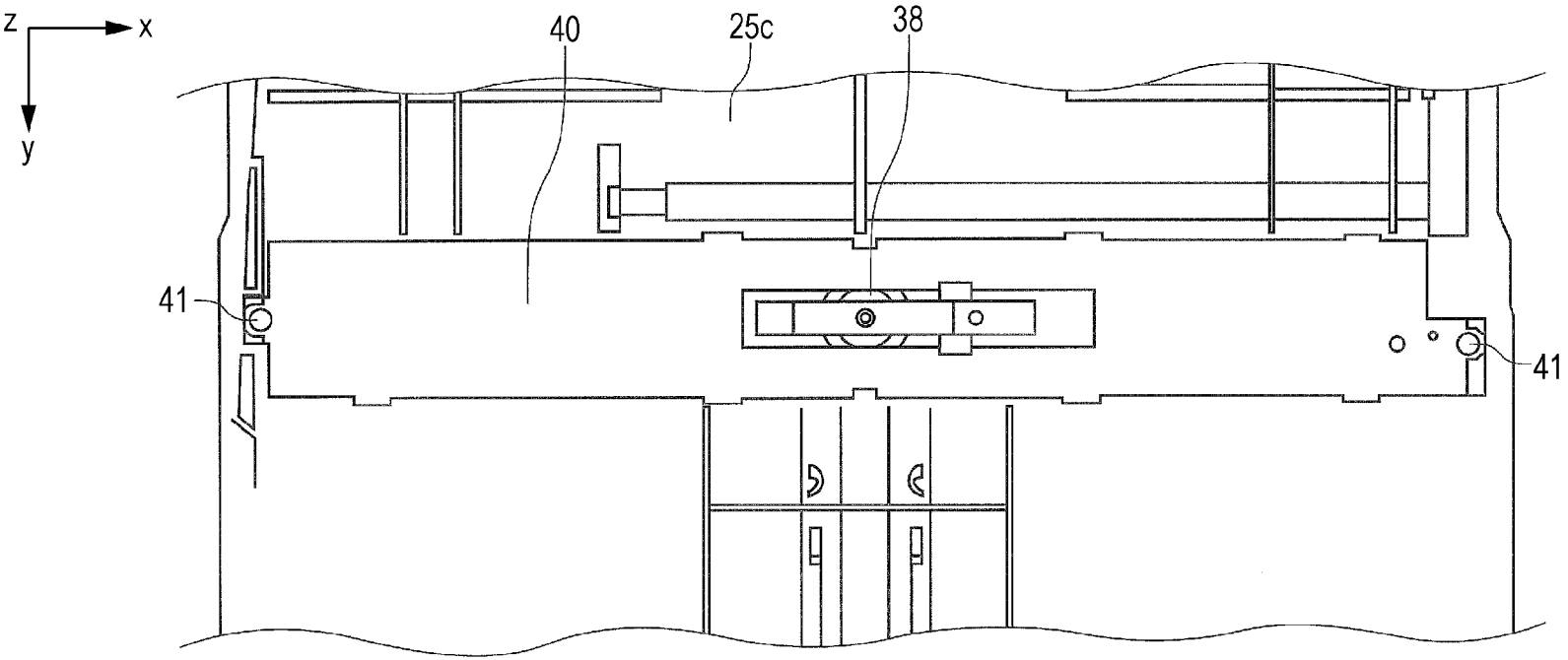
FIG. 6 is an enlarged plan view of the back of the sheet cassette according to the invention.
Figure 7:
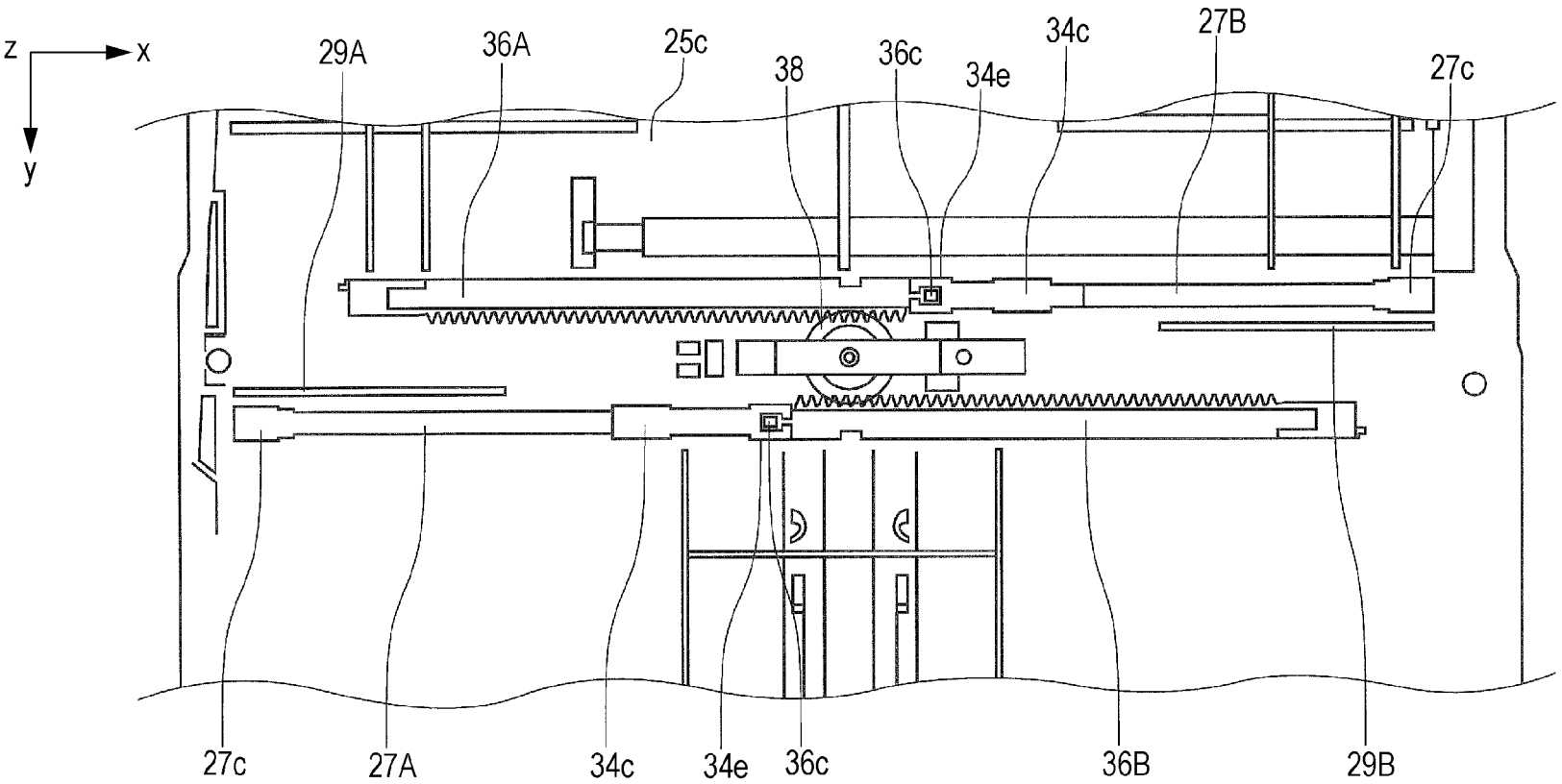
FIG. 7 is an enlarged plan view of the back of the sheet cassette according to the invention (with a cover taken off).
Figure 8:
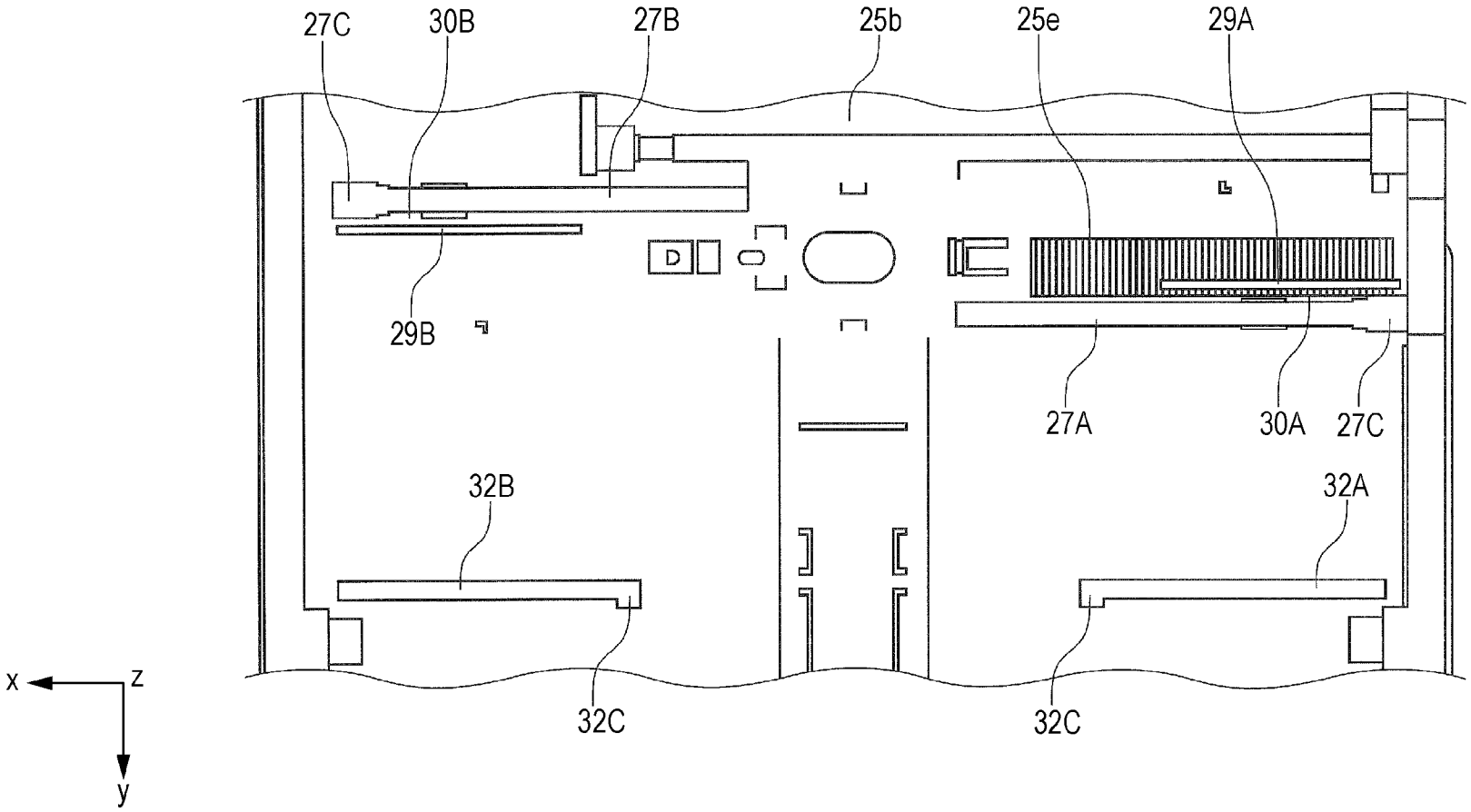
FIG. 8 is an enlarged plan view of the face of the sheet cassette according to the invention (with an edge guide taken off).

FIGS. 1 and 2 are side cross-sectional views of an ink jet printer (hereinafter, referred to as "printer") 1 which is an embodiment of "the recording apparatus" according to the invention. FIG. 3 is a perspective view of a sheet cassette 25 which is a medium mounting mechanism according to an embodiment of the invention seen from the face. FIG. 4 is a perspective view of the sheet cassette 25 seen from the back. FIG. 5 is an enlarged plan view of the face of the sheet cassette 25. FIG. 6 is an enlarged plan view of the back of the sheet cassette 25. FIG. 7 is an enlarged plan view of the back of the sheet cassette 25 (with a cover member 40 taken off). FIG. 8 is an enlarged plan view of the face of the sheet cassette 25 (with edge guides 34A and 34B taken off).

Figure 9:
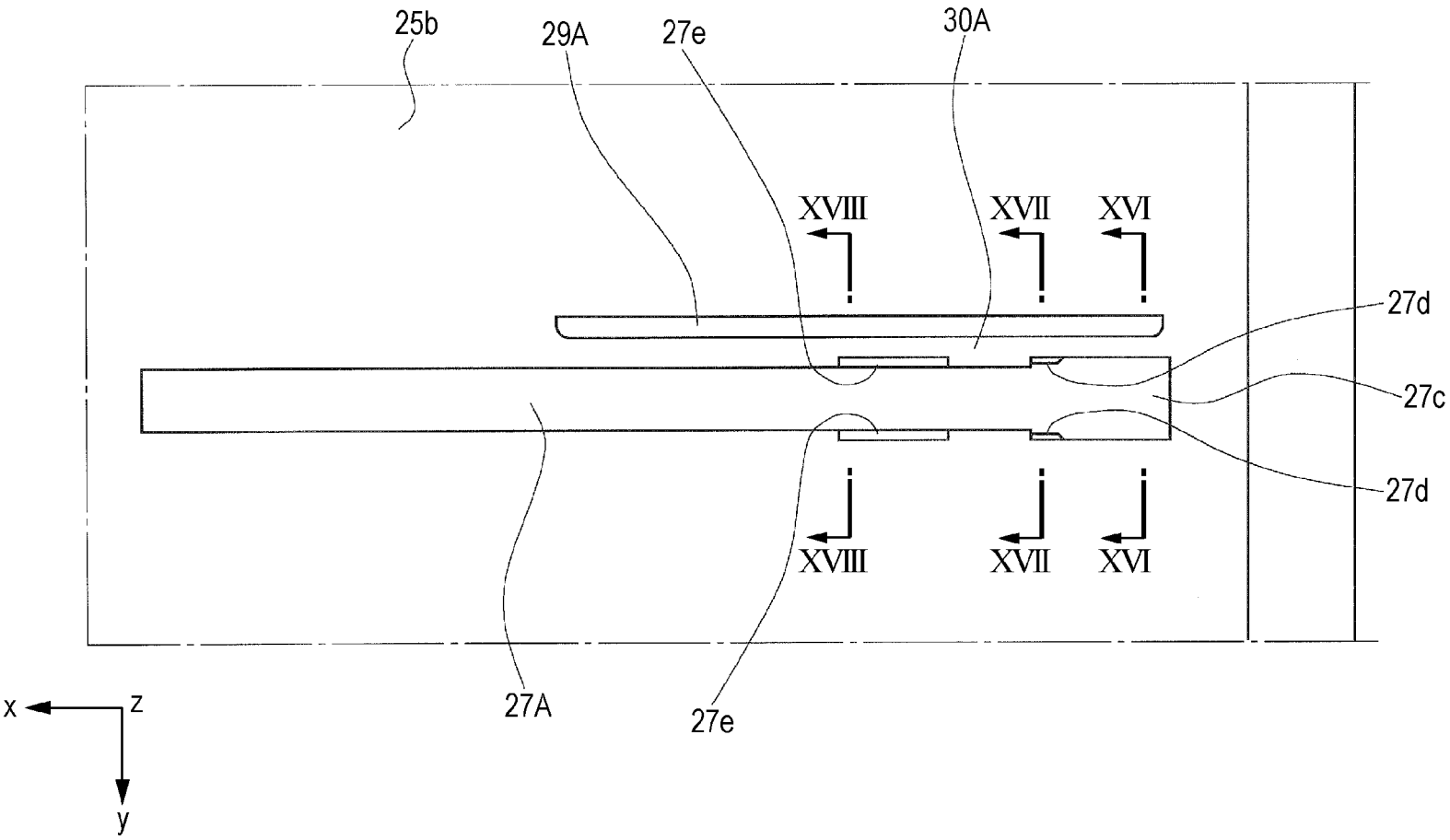
FIG. 9 is an enlarged plan view of a guide groove and a widening allowance groove seen from the face.
Figure 10:
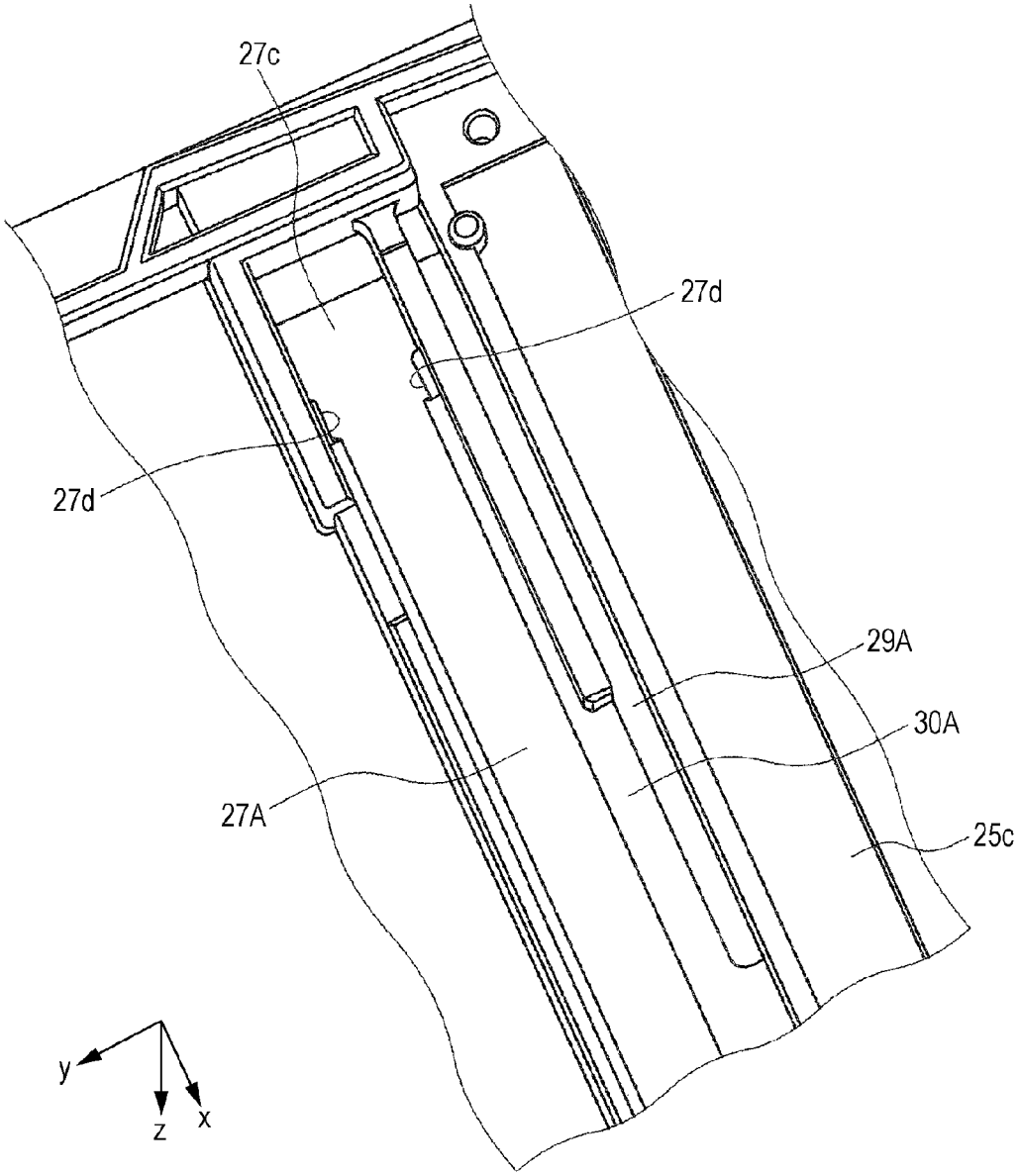
FIG. 10 is an enlarged perspective view of the guide groove and the widening allowance groove seen from the back.
Figure 11:
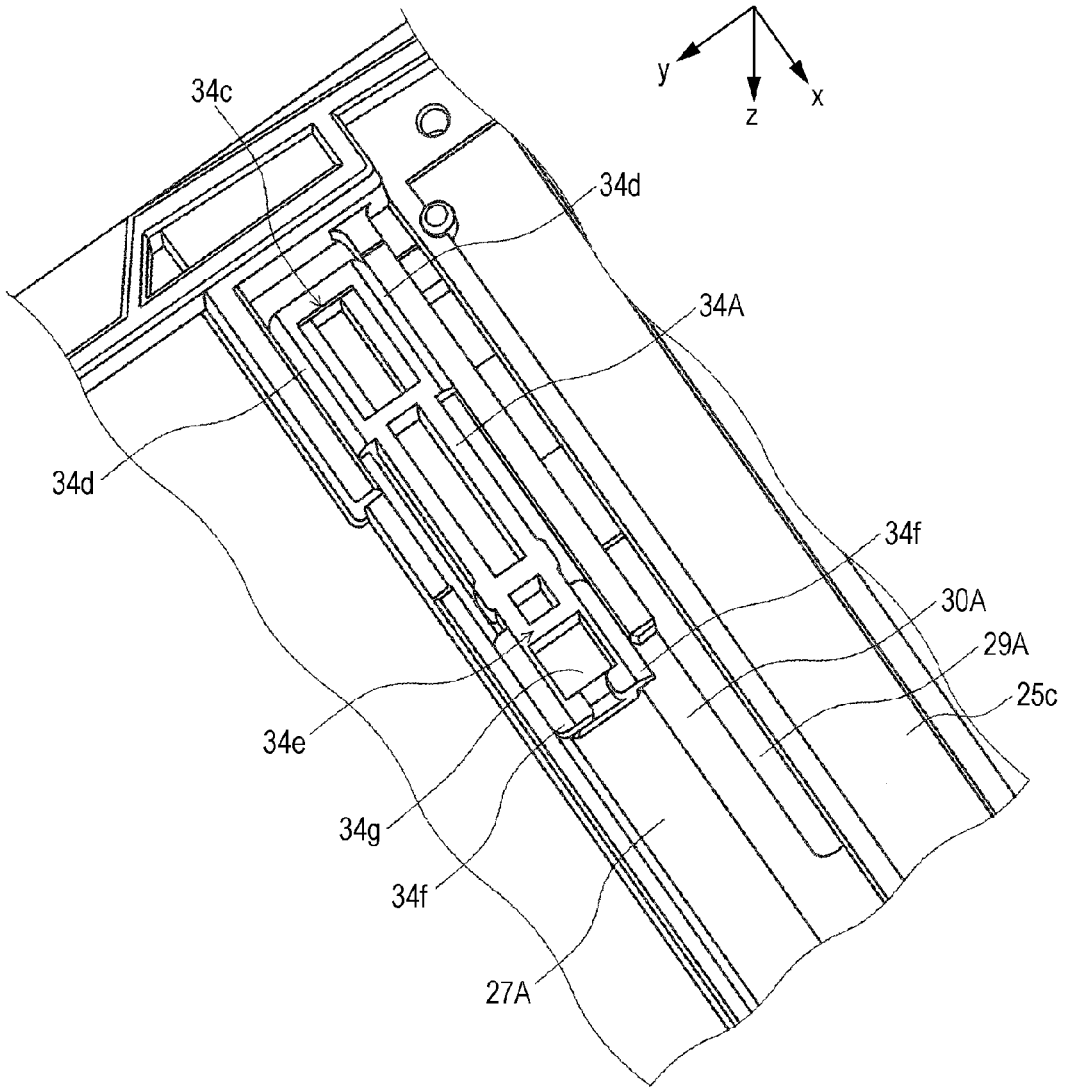
FIG. 11 is an enlarged perspective view of the guide groove and the widening allowance groove seen from the back.
Figure 12:
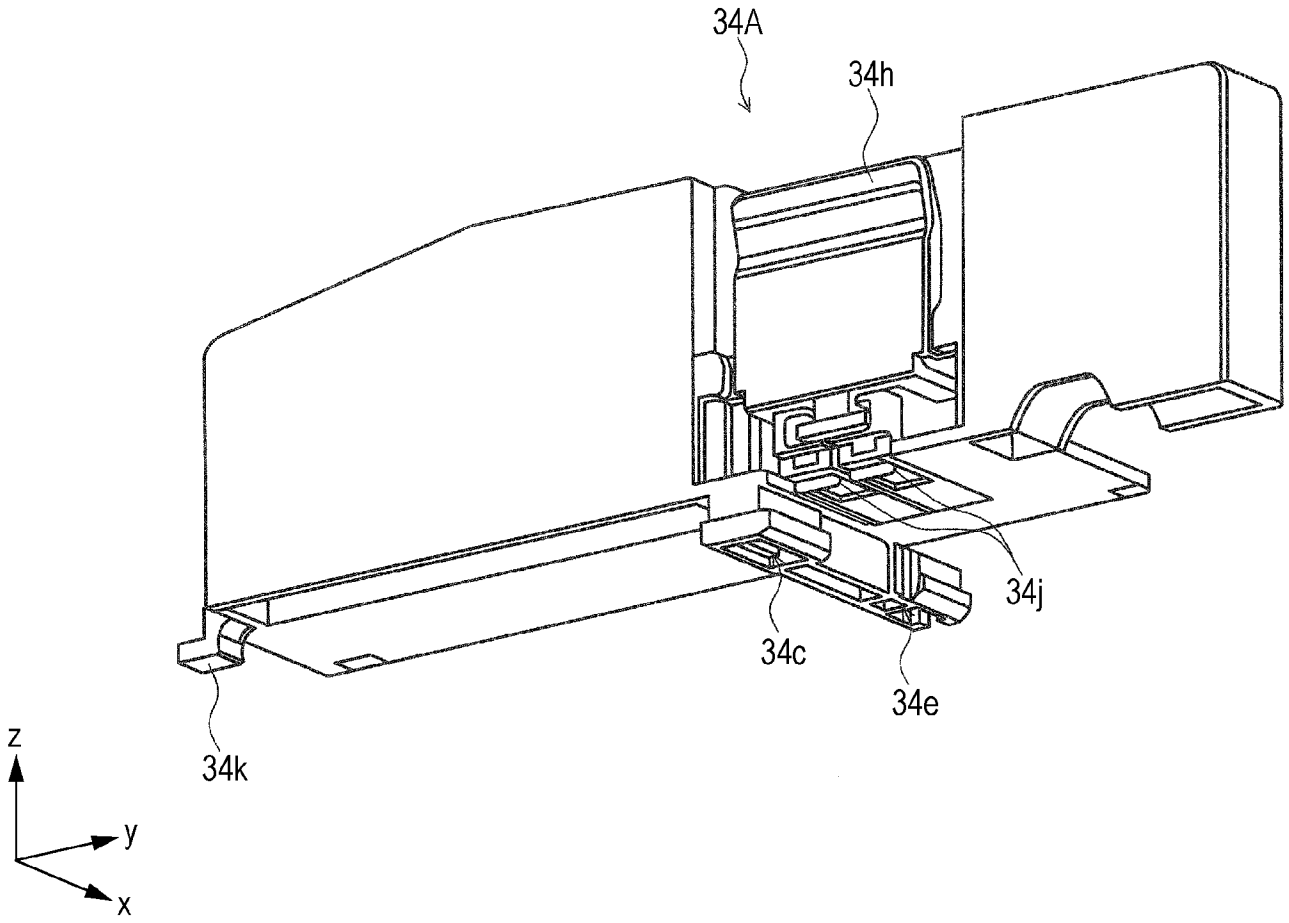
FIG. 12 is an overall perspective view of an edge guide.
Figure 13:
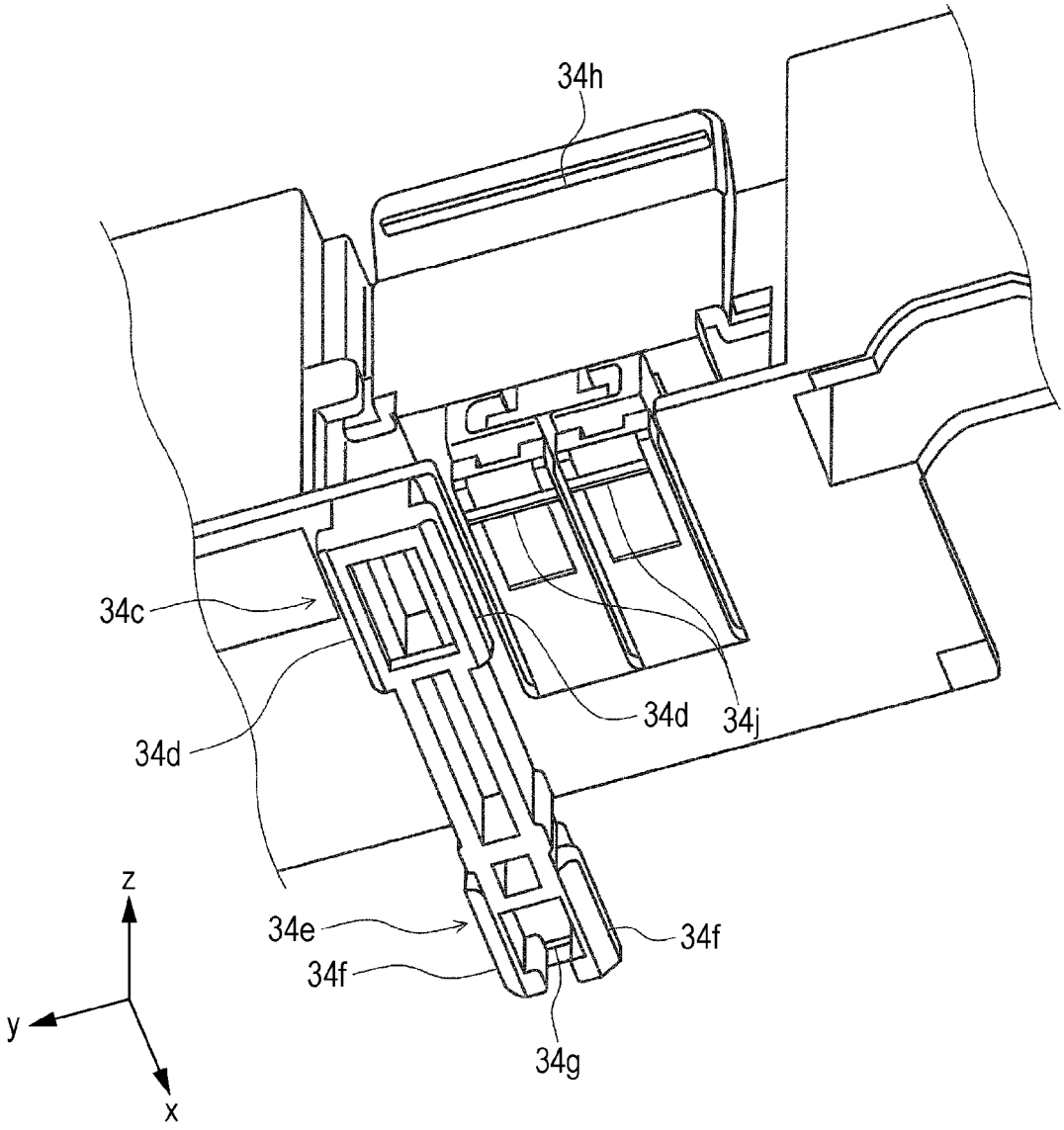
FIG. 13 is a partial enlarged perspective view of the edge guide.
Figure 14:
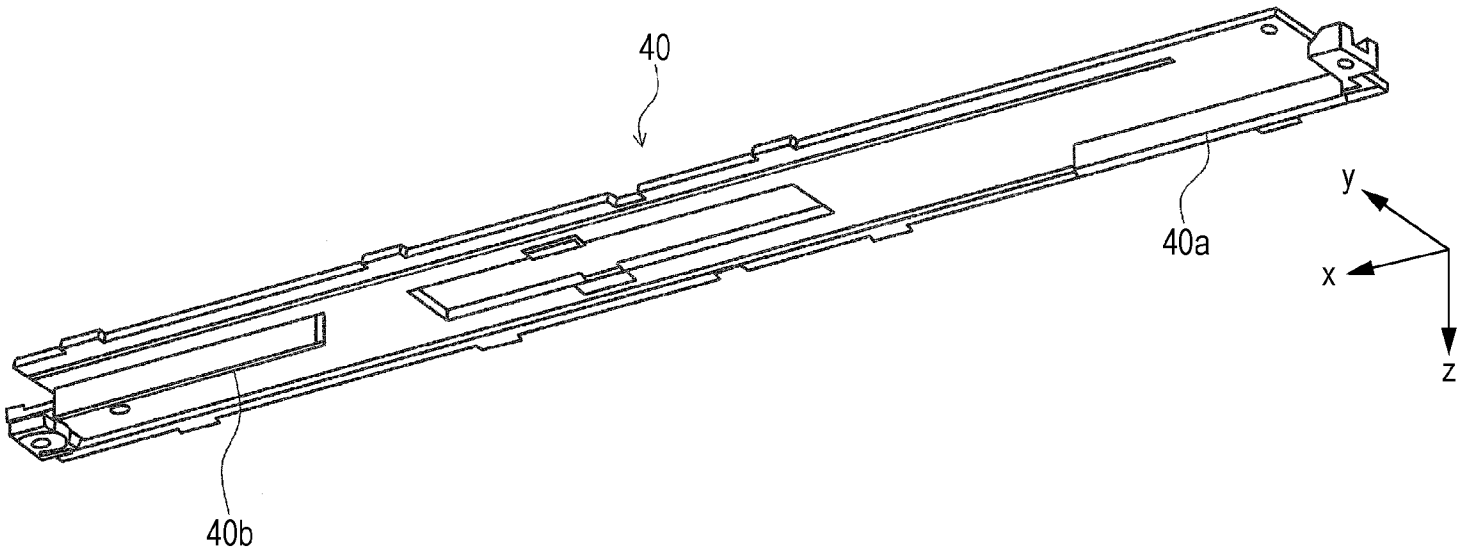
FIG. 14 is a perspective view of a cover.
Figure 15:
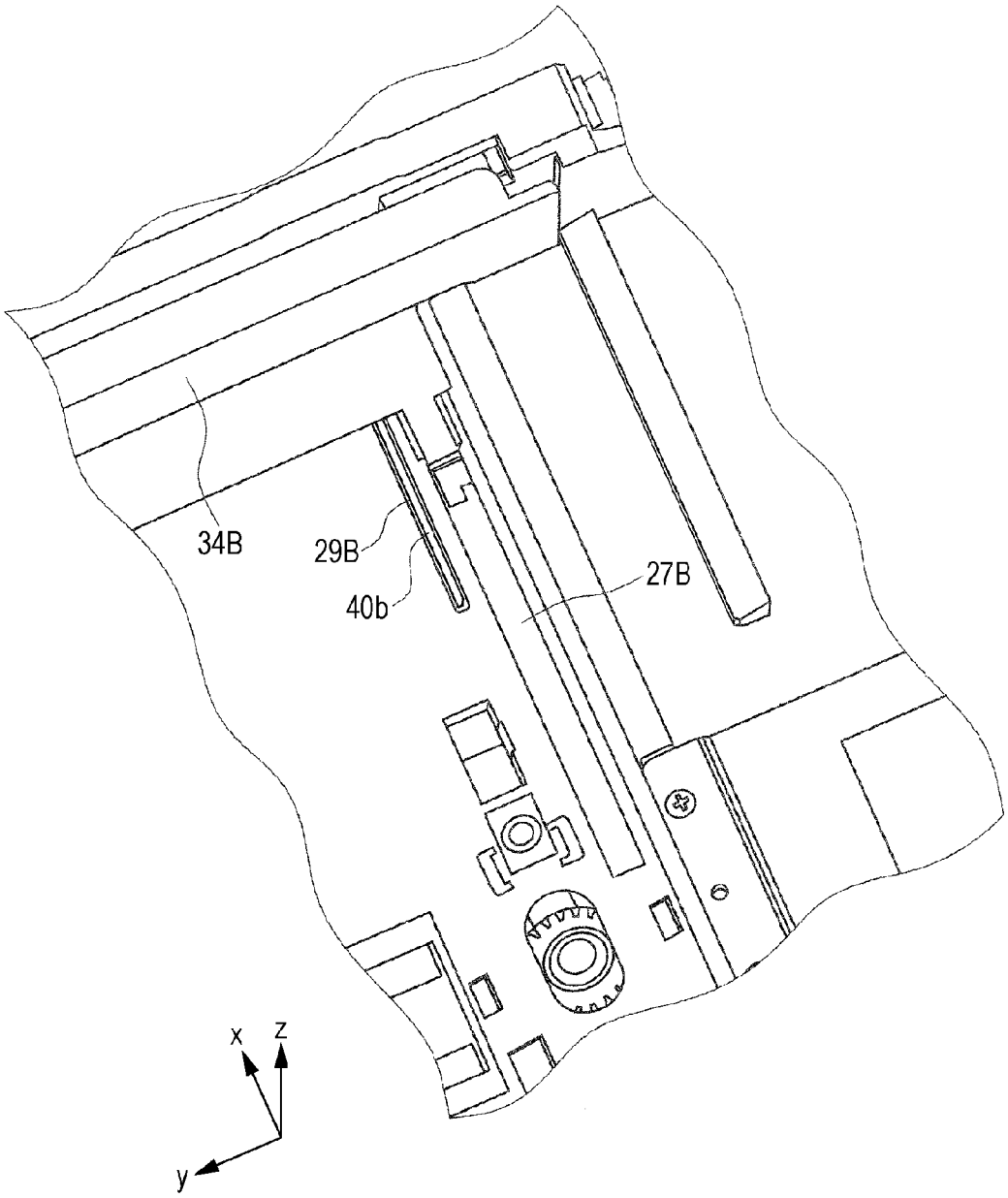
FIG. 15 is an enlarged perspective view of the guide groove and the widening allowance groove seen from the face.

In addition, FIG. 9 is an enlarged plan view of a guide groove 27A and a widening allowance groove 29A seen from the face. FIGS. 10 and 11 are enlarged perspective views of the guide groove 27A and the widening allowance groove 29A seen from the back. FIG. 12 is an overall perspective view of the edge guide 34A. FIG. 13 is a partial enlarged perspective view of the edge guide 34A. FIG. 14 is a perspective view of a cover member 40. FIG. 15 is an enlarged perspective view of a guide groove 27B and a widening allowance groove 29B seen from the face.

Figure 16A:
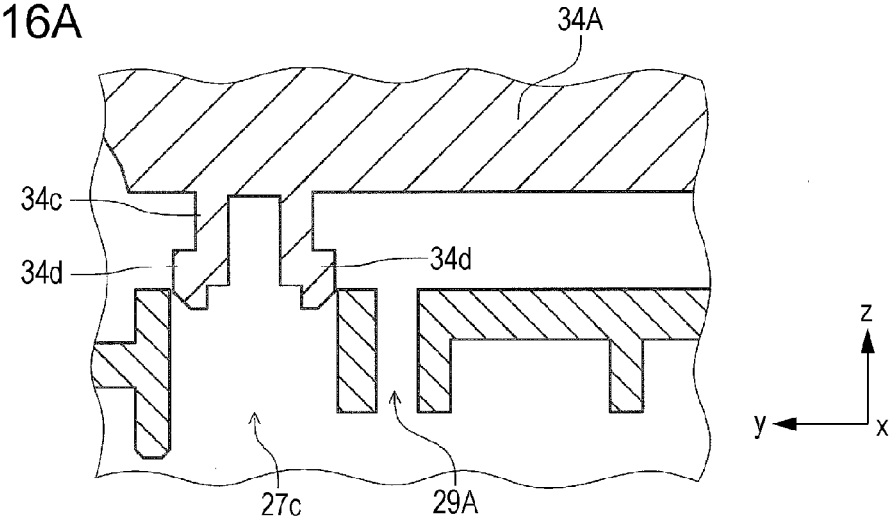
FIG. 16A is a cross-sectional view taken along the line XVIA-XVIA in FIG. 9.
Figure 16B:
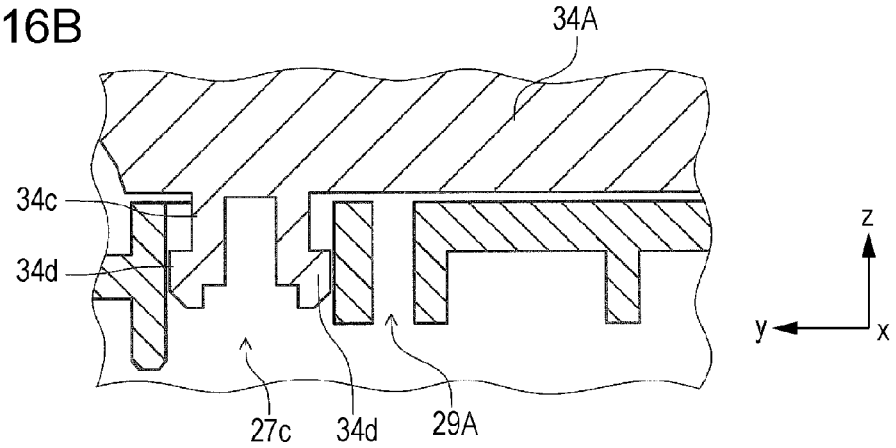
FIG. 16B is a cross-sectional view taken along the line XVIB-XVIB in FIG. 9.
Figure 16C:
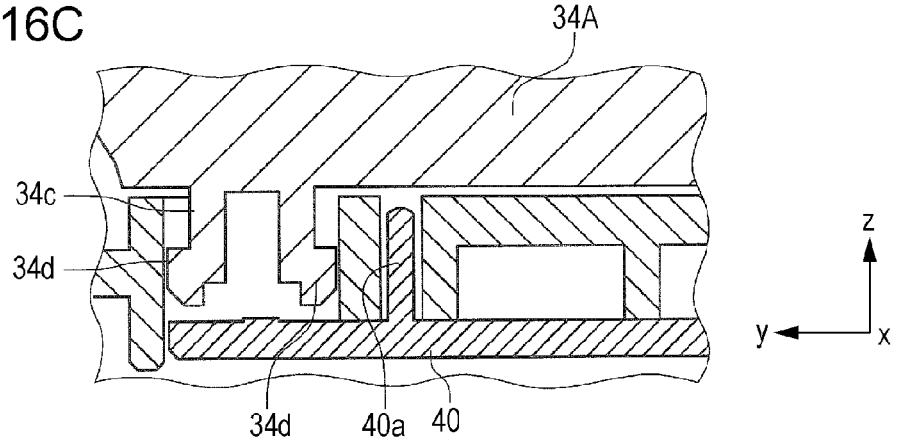
FIG. 16C is a cross-sectional view taken along the line XVIC-XVIC in FIG. 9.
Figure 17A:
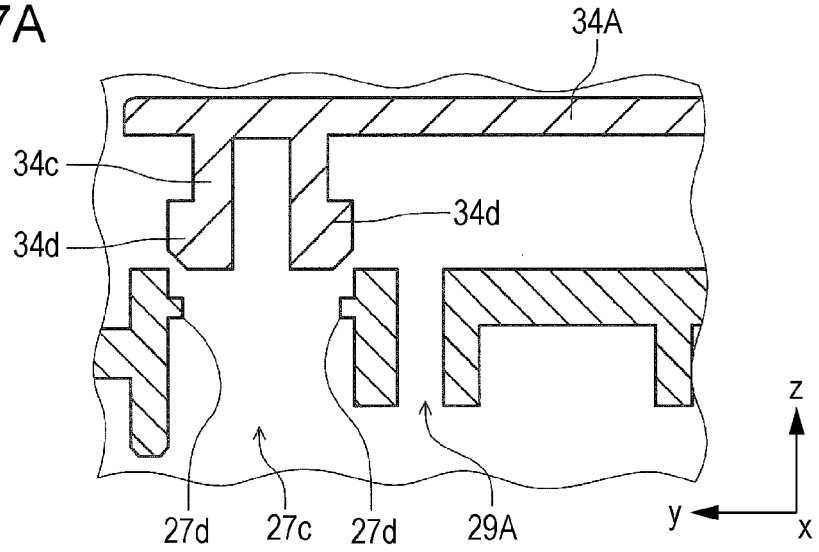
FIG. 17A is a cross-sectional view taken along the line XVIIA-XVIIA in FIG. 9.
Figure 17B:
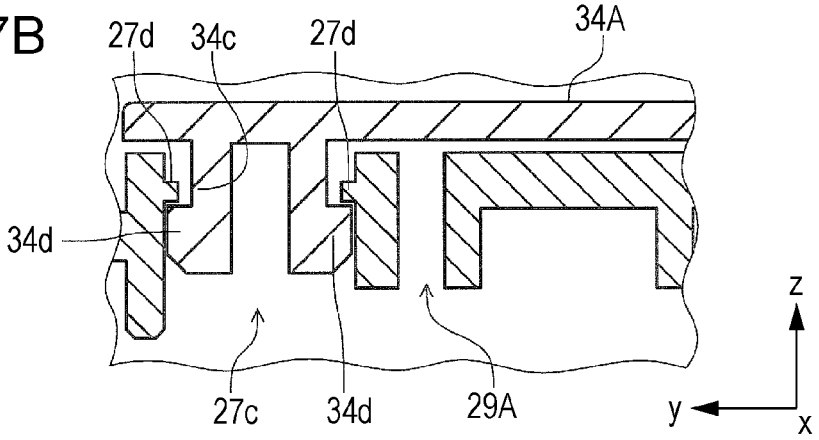
FIG. 17B is a cross-sectional view taken along the line XVIIB-XVIIB in FIG. 9.
Figure 17C:
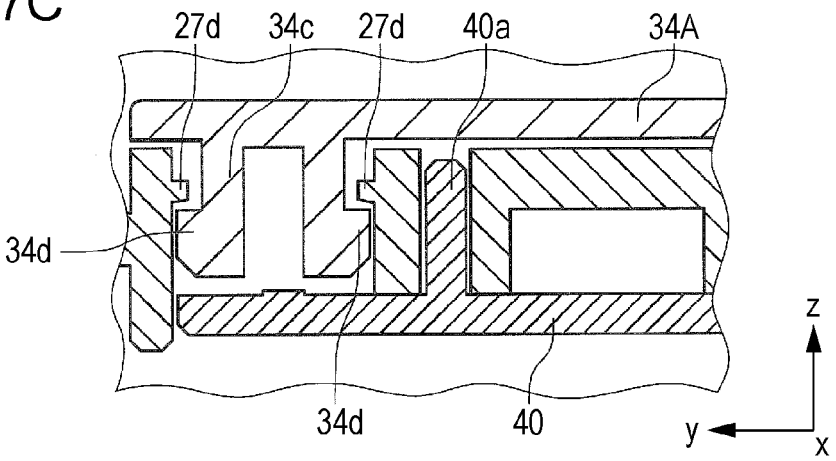
FIG. 17C is a cross-sectional view taken along the line XVIIC-XVIIC in FIG. 9.
Figure 18A:
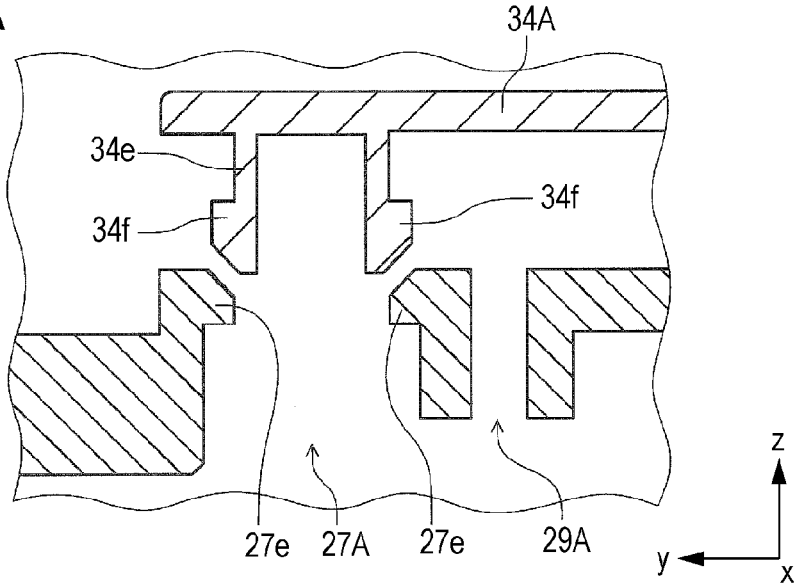
FIG. 18A is a cross-sectional view taken along the line XVIIIA-XVIIIA in FIG. 9.
Figure 18B:
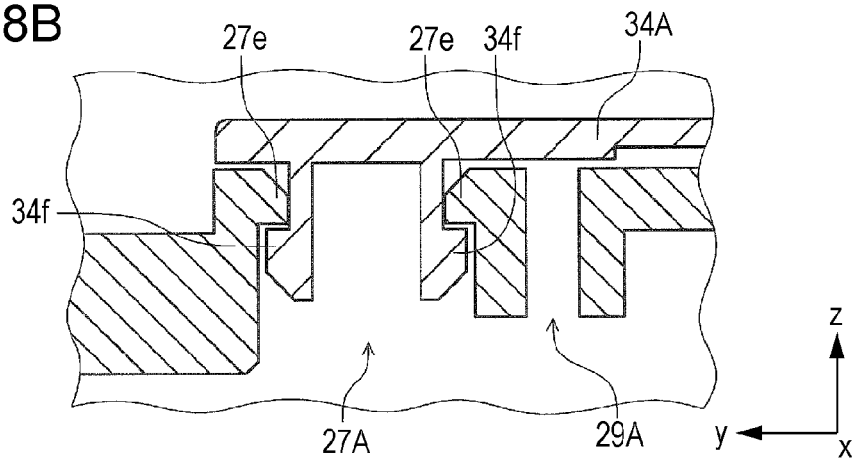
FIG. 18B is a cross-sectional view taken along the line XVIIIB-XVIIIB in FIG. 9.
Figure 18C:
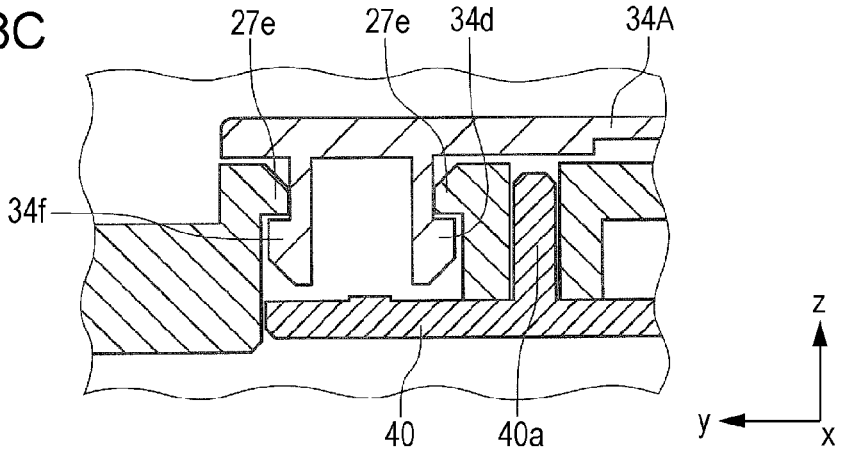
FIG. 18C is a cross-sectional view taken along the line XVIIIC-XVIIIC in FIG. 9.

Further, FIG. 16A is a cross-sectional view taken along the line XVIA-XVIA in FIG. 9, FIG. 16B is a cross-sectional view taken along the line XVIB-XVIB in FIG. 9, and FIG. 16C is a cross-sectional view taken along the line XVIC-XVIC in FIG. 9. FIGS. 16A, 16B, and 16C illustrate a change in a state when an insertion portion 34*c* is inserted into a widening portion 27*c* of the guide groove 27A. FIG. 17A is a cross-sectional view taken along the line XVIIA-XVIIA in FIG. 9, FIG. 17B is a cross-sectional view taken along the line XVIIB-XVIIB in FIG. 9, and FIG. 17C is a cross-sectional view taken along the line XVIIC-XVIIC in FIG. 9. FIGS. 17A, 17B, and 17C illustrate a change in a state when the insertion portion 34*c* is inserted into the widening portion 27*c* of the guide groove 27A. FIG. 18A is a cross-sectional view taken along the line XVIIIA-XVIIIA in FIG. 9, FIG. 18B is a cross-sectional view taken along the line XVIIIB-XVIIIB in FIG. 9, and FIG. 18C is a cross-sectional view taken along the line XVIIIC-XVIIIC in FIG. 9. FIGS. 18A, 18B, and 18C illustrate a change in a state when a center insertion portion 34*e* is inserted into the guide groove 27A.

Figure 19:
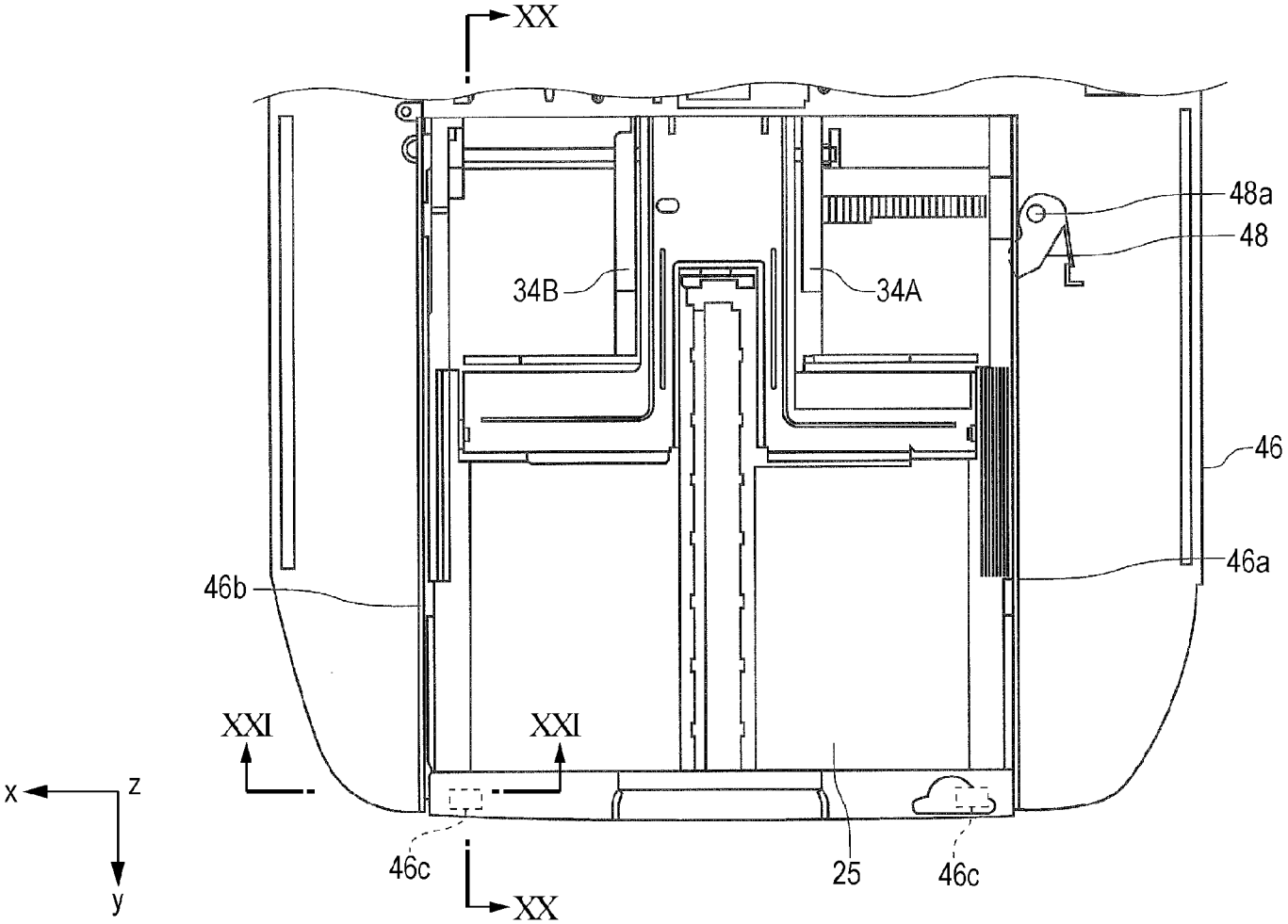
FIG. 19 is a plan view of a state in which a cassette is mounted on a main body frame which configures an apparatus main body.
Figure 20:
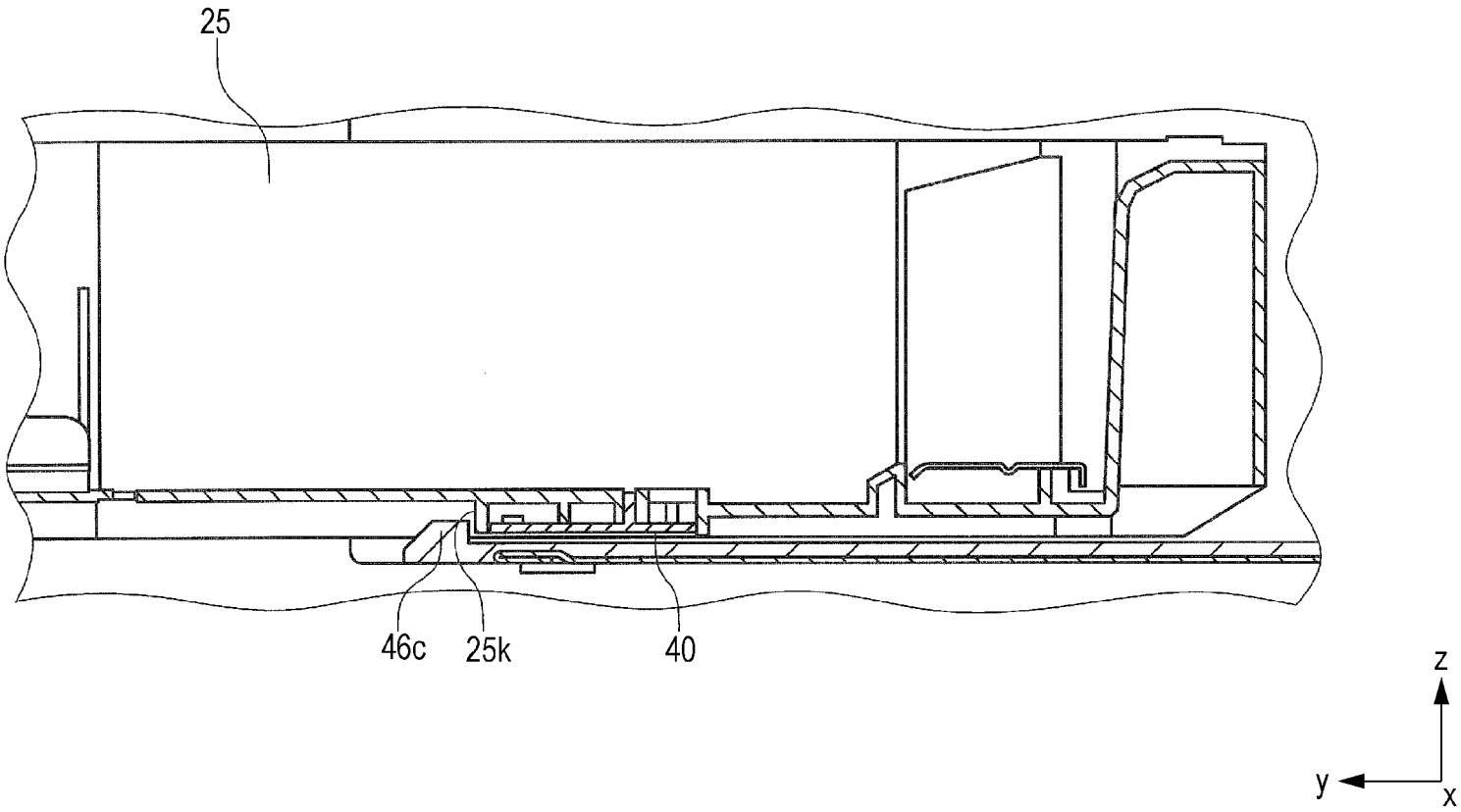
FIG. 20 is a view of a state in which the sheet cassette is being detached in a cross-section taken along the line XX-XX in FIG. 19.
Figure 21:
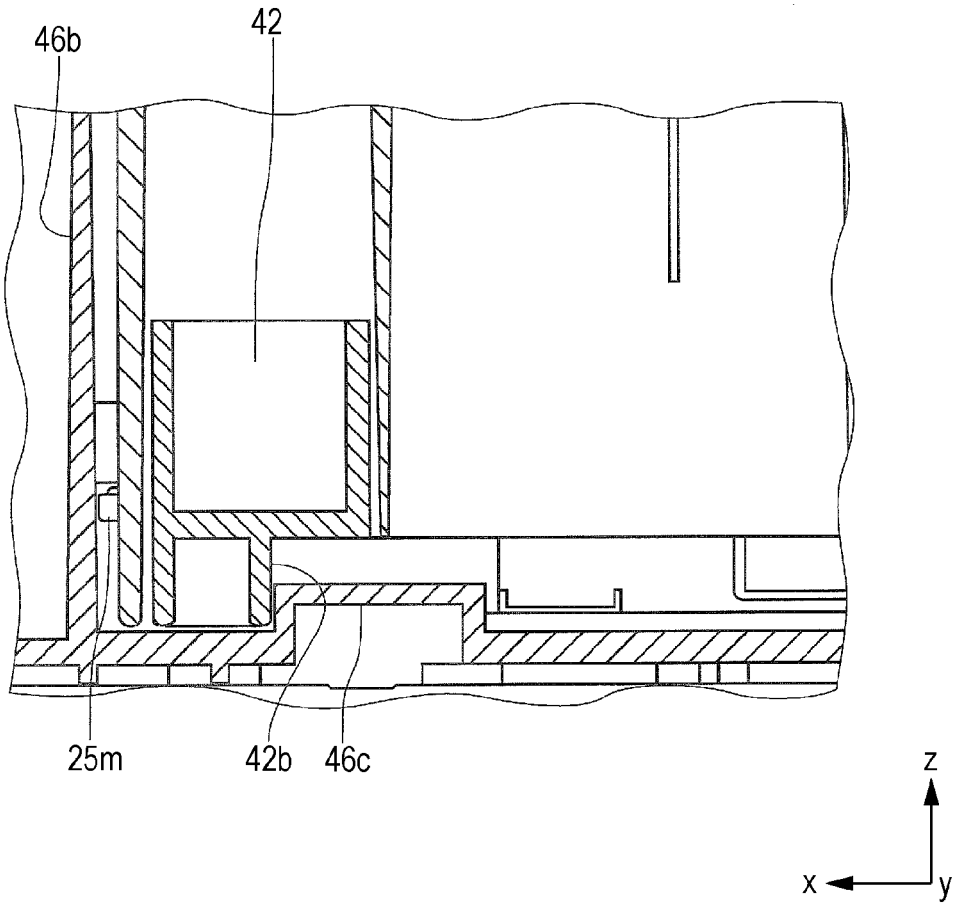
FIG. 21 is a cross-sectional view taken along the line XXI-XXI in FIG. 19.
Figure 22:
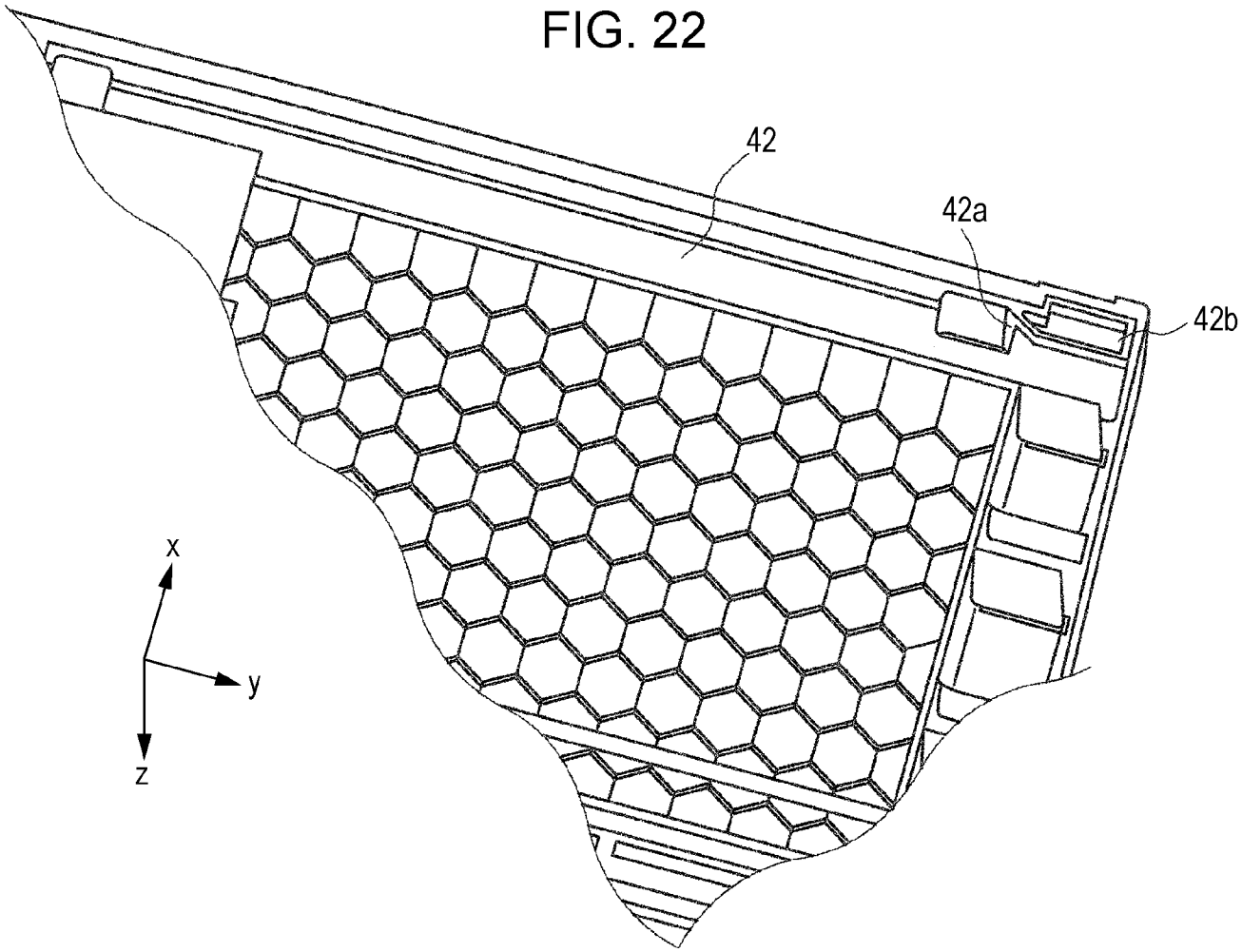
FIG. 22 is a partial enlarged perspective view of the back of the sheet cassette.
Figure 23:
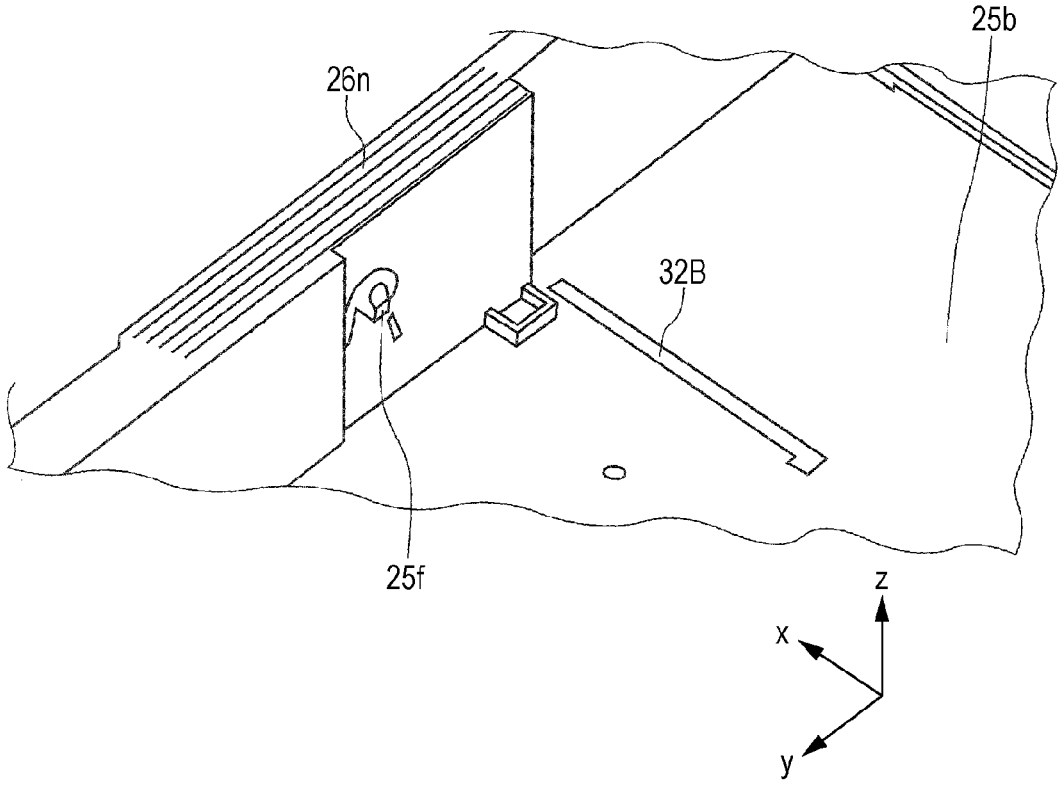
FIG. 23 is a perspective view of a swing shaft of a hopper.
Figure 24:
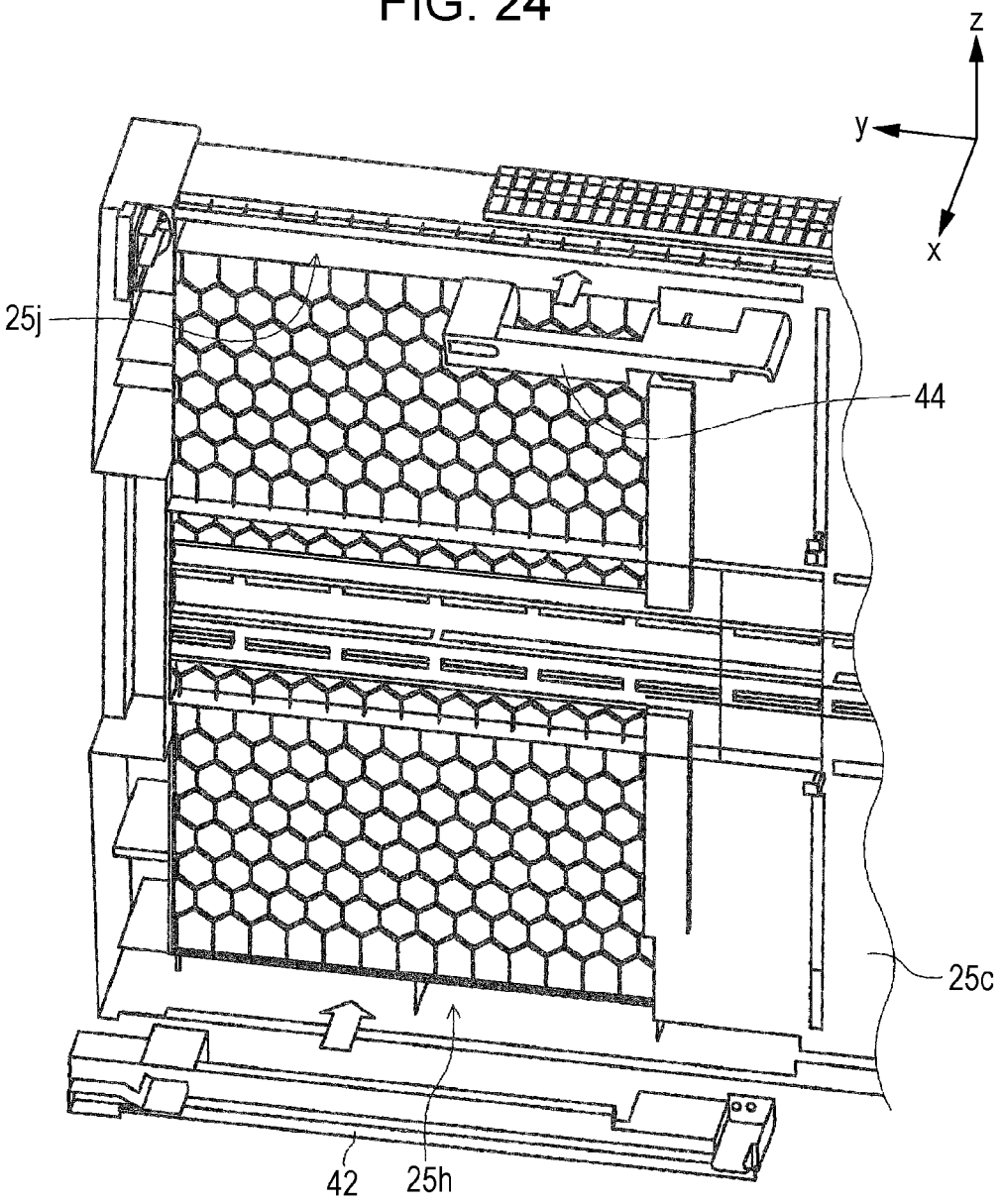
FIG. 24 is an exploded perspective view of the back of the sheet cassette.
Figure 25B:
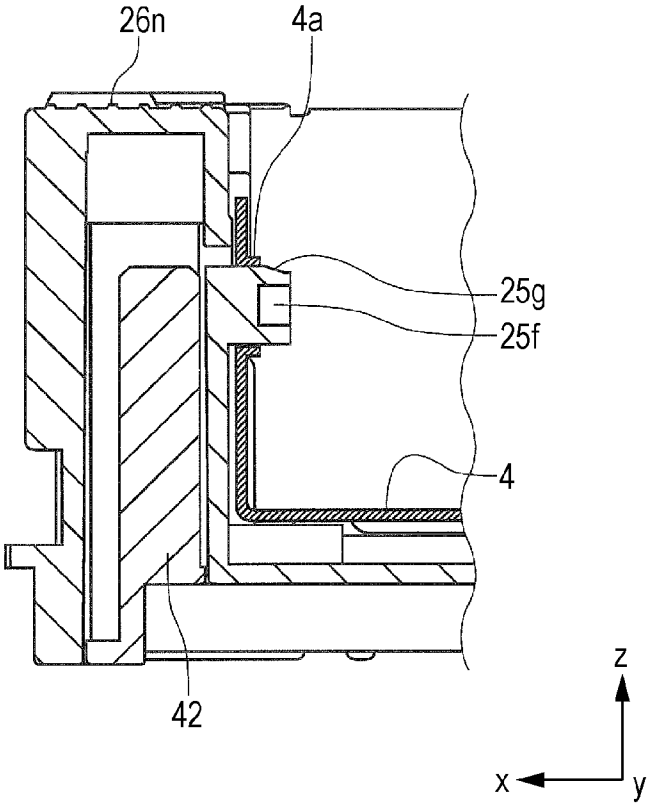
FIGS. 25A and 25B are cross-sectional views of a portion of the swing shaft of the hopper.
Figure 25A:
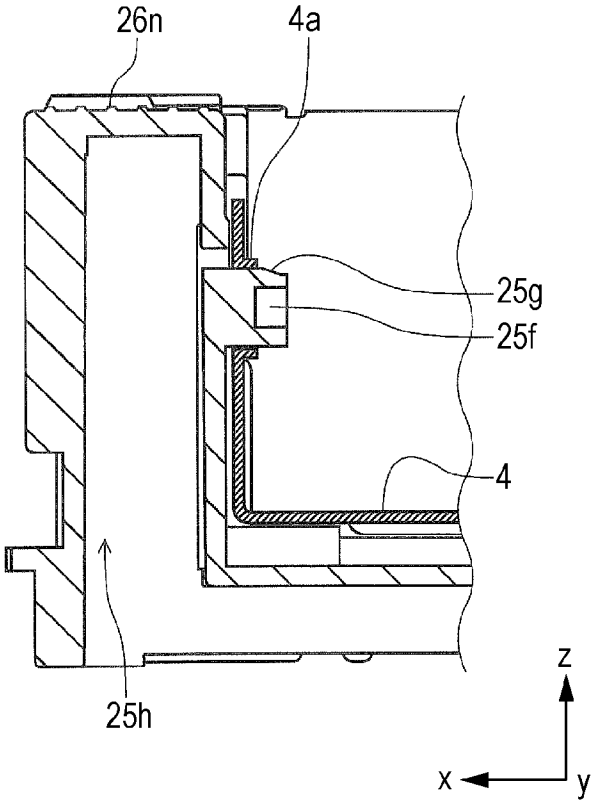

In addition, FIG. 19 is a plan view of a state in which the sheet cassette 25 is mounted on a main body frame 46 which configures an apparatus main body 2. FIG. 20 is a view of a state when the sheet cassette 25 is being detached in a cross-section taken along the line XX-XX in FIG. 19. FIG. 21 is a cross-sectional view taken along the line XXI-XXI in FIG. 19. FIG. 22 is a partial enlarged perspective view of the back of the sheet cassette 25. FIG. 23 is a perspective view of a swing shaft 25*f* a hopper 4. FIG. 24 is an exploded perspective view of the back of the sheet cassette 25. FIGS. 25A and 25B are cross-sectional views of a portion of the swing shaft 25*f* of the hopper 4. FIG. 25A is a view illustrating a state before attaching a first spacer 42, and FIG. 25B is a view illustrating a state after attaching the first spacer 42.

Further, in the x-y-z orthogonal coordinate system illustrated in each drawing, the x direction and the y direction are horizontal directions. The x direction is a sheet width direction as well as a left-to-right direction of the apparatus. In addition, the y direction is a sheet transporting direction as well as an apparatus depth direction. Further, the z direction is a gravity direction as well as an apparatus height direction. Moreover, the x-y-z coordinate system in FIG. 3 or subsequent drawings illustrating a single body of the sheet cassette 25 corresponds to each direction when the sheet cassette 25 is mounted on the printer 1.

Hereinafter, an overall configuration of the printer 1 will be described mainly referring to FIGS. 1 and 2. The printer 1 has a configuration in which, on the apparatus main body 2 performing ink jet recording on a recording sheet P as an example of a recording medium which is a medium, the sheet cassette 25 accommodating a plurality of recording sheets P is detachably (slidably) mounted, and the recording sheet P is fed from the sheet cassette 25 one by one. The sheet cassette 25 is mounted toward the left side from the right side (in the y− direction) of FIGS. 1 and 2, and is withdrawn toward the right side from the left side (in the y+ direction) of FIGS. 1 and 2.

The apparatus main body 2 is provided with a first feed roller 8 and a second feed roller 9 which are rotatably driven by a power source (motor) (not illustrated). The first feed roller 8 and the second feed roller 9 are configured to be positioned above a leading end of the sheet cassette 25 (left side in FIGS. 1 and 2) in a state where the sheet cassette 25 is mounted.

The bottom portion of the sheet cassette 25 is provided with the hopper 4 which pushes up the accommodated recording sheets P by swinging around a swing shaft 4*a* (refer to FIG. 3 as well). With the hopper 4 pushing up the recording sheets P, one at the top among the accommodated recording sheets P comes into contact with the first feed roller 8 as illustrated in FIG. 2. Accordingly, rotation of the first feed roller 8 (normal rotation) in this state causes the recording sheet P to be sent out from the sheet cassette 25.

The dashed line in FIG. 2 illustrates a passing trajectory of the recording sheet P sent out from the sheet cassette 25.

In a sheet accommodation region of the sheet cassette 25, the edge guides 34A and 34B guiding a side end of the accommodated recording sheets P as illustrated in FIG. 3 are provided in a slidably displaceable manner in a sheet width direction, and the edge guide 35 guiding a rear end of the recording sheets P is also provided in a slidably displaceable manner in a sheet sending-out direction.

A separation roller 5 is provided in an end portion of the sheet cassette 25 in the sheet sending-out direction (downstream side). When the sheet cassette 25 is mounted, the separation roller 5 comes into contact with the second feed roller 9. Accordingly, the recording sheet P sent out by the first feed roller 8 is nipped between the separation roller 5 and the second feed roller 9.

Here, the separation roller 5 is provided in a state in which a predetermined rotation resistance is given. Since the sheet at the top among the recording sheets P which is sent out by the first feed roller 8 is rotatably driven to come into contact with the second feed roller 9, the sheet is given a transport force from the second feed roller 9 and is able to proceed toward the downstream side. However, the recording sheets P at the second top of subsequent positions which may be brought by the recording sheet P at the top to be fed and then may be double-fed are not given a transport force from the second feed roller 9 and comes to a halt at the position of the separation roller 5, and thereby double-feeding is prevented.

In a cassette main body 25*a* which forms the sheet accommodation region in the sheet cassette 25, a preliminary separation slope 25*d* is formed on both sides of the sheet width direction with respect to the separation roller 5 as illustrated in FIG. 3. Since the leading end of the recording sheet P sent out from the sheet cassette 25 proceeds toward the downstream side while being in sliding contact with the preliminary separation slope 25*d*, a preliminary separation before reaching the separation roller 5 is performed.

The rotation direction (normal direction) of the first feed roller 8 and the second feed roller 9 when the recording sheet P is fed from the sheet cassette 25 is a clockwise direction of FIGS. 1 and 2, and the opposite direction thereof is the counter-clockwise direction of FIGS. 1 and 2.

Subsequently, a first intermediate roller 11 and a second intermediate roller 12 which are transport rollers transporting the recording sheet P are provided on the downstream side of the second feed roller 9. The first intermediate roller 11 and the second intermediate roller 12 have almost the same diameter, are given a power of the motor (not illustrated) (FIG. 3), and are rotatably driven in the clockwise-direction of FIGS. 1 and 2. The recording sheet P sent out from the sheet cassette 25 is given a transport force from the first intermediate roller 11 and the second intermediate roller 12 and thus is transported toward the downstream side.

The signs 14*a* and 14*b* represent driven rollers which nip the recording sheet P with the first intermediate roller 11 and thereby are driven to rotate. The signs 14*c* and 14*d* represent driven rollers which nip the recording sheet P with the second intermediate roller 12 and thereby are driven to rotate.

Subsequently, a pair of transport rollers 16 which is driven to rotate is provided on the downstream side of the second intermediate roller 12. The pair of transport rollers 16 transports the recording sheet P to a recording region. A recording head 20 which ejects ink onto the recording sheet P and a support member 18 which supports the recording sheet P are provided on the downstream side of the pair of transport rollers 16. The recording head 20 is provided in a carriage 19 which is driven in a sheet width direction (main scanning direction).

A pair of first discharge rollers 22 and a pair of second discharge rollers 23 are provided on the downstream side of a region where the support member 18 and the recording head 20 are able to face each other (recording region). The recording sheet P onto which recording is performed is discharged by these pairs of discharge rollers.

Subsequently, the sheet cassette 25 will be further described in detail referring to FIG. 3 and the subsequent drawings. The sheet cassette 25 is provided with the edge guides 34A and 34B which guide a side end of a sheet as described above on a bottom surface 25*b* of the sheet accommodation region. In addition, the sheet cassette 25 is provided with the edge guide 35 which guides a rear end of a sheet. The edge guides 34A and 34B are provided in a slidably displaceable manner in the sheet width direction (x direction), and the edge guide 35 is provided in a slidably displaceable manner in the sheet length direction (y direction).

Hereinafter, an attachment structure of the edge guides 34A and 34B will be mainly described. On the bottom surface 25*b*, a main guide groove 27A, a sub guide groove 32A, and a widening allowance groove 29A which extend in a displacement direction (x direction) of the edge guide 34A are formed, corresponding to the edge guide 34A as illustrated in FIGS. 3, 4, 5, and 8. In addition, a main guide groove 27B, a sub guide groove 32B, and a widening allowance groove 29B which extend in a displacement direction (x direction) of the edge guide 34B are formed, corresponding to the edge guide 34B. All of the grooves in the embodiment are formed as slots passing from the bottom surface 25*b* to a back surface 25*c* of the cassette.

FIG. 5 illustrates a state in which the edge guides 34A and 34B are the closest with each other. FIG. 8 illustrates all of the respective grooves, with the edge guides 34A and 34B taken off.

In a case of a so-called center feeding in which a feed roller is positioned in the center of a sheet, the edge guides 34A and 34B are provided so as to be symmetrical to the center of the sheet width direction, and to be displaced in a direction of growing away from each other or growing closer from each other. For this reason, each groove corresponding to each edge guide is in a bisymmetrical form, symmetrical to a center position in the sheet width direction (arrangement position of a pinion gear 38 to be described later). In addition, the sub guide grooves 32A and 32B are in the same position as each other in the y direction and are arranged bisymmetrically. In addition, the main guide grooves 27A and 27B are in different positions from each other in the y direction but are in the bisymmetrical position to each other in the x direction. Furthermore, the widening allowance grooves 29A and 29B are also in different positions from each other in the y direction but are in the bisymmetrical position to each other in the x direction.

Therefore, even in a case of describing each groove corresponding to any one of the edge guides 34A and 34B, the groove basically has the same structure as the groove corresponding to the other edge guide, and thus redundant descriptions will be appropriately skipped.

In a case of a one-sided feeding in which a feed roller is positioned in a non-center portion in the sheet width direction, a configuration in which any one of the edge guides 34A and 34B is provided may be employed.

However, a fixing protrusion 25*e* illustrated in FIG. 8 is formed only on a side of the edge guide 34A. The fixing protrusion 25*e* is formed of saw-toothed irregularities along the main guide groove 27A. Holding protrusions 34*j* (illustrated in FIGS. 12 and 13) provided only in the edge guide 34A mesh with the fixing protrusions 25*e* so that the edge guide 34 is held in a predetermined position. In addition, the edge guides 34A and 34B are configured to be displaced in an interlocking manner by a rack and pinion mechanism to be described later, that is, the edge guides 34A and 34B are configured so that, when any one of the edge guides is operated, the other one is also operated. Thus, when the edge guide 34A is held in a predetermined position, the edge guide 34B is also held in the predetermined position.

The holding protrusions 34*j* are provided below an unlocking lever 34*h* as illustrated in FIGS. 12 and 13. When the unlocking lever 34*h* is moved in the x direction in FIG. 12, the holding protrusions 34*j* are displaced in the z direction in FIG. 12, that is, a direction of being distanced from the fixing protrusion 25*e* formed on the bottom surface of the cassette. With this, a state in which the edge guides are held by the holding protrusions 34*j* meshing with the fixing protrusions 25*e* is released, and thus it becomes possible to displace the edge guides.

Subsequently, each edge guide in FIGS. 5 to 9 is basically guided in a sliding direction by a main guide groove and a sub guide groove, that is, the edge guide 34A is guided in the sliding direction by the main guide groove 27A and the sub guide groove 32A.

The sub guide groove 32A is provided with a widening portion 32*c* formed on a center side of the cassette. A hook-shaped sub insertion portion 34*k* (FIG. 12) which is a portion of the edge guide 34A is inserted into the sub guide groove 32A through the sub widening portion 32*c*. Accordingly, when attaching the edge guide 34A to the sheet cassette 25, the edge guide 34A is first placed in the centermost position of the cassette (position in FIG. 5) and then the sub insertion portion 34*k* is inserted into the widening portion 32*c*. When the sub insertion portion 34*k* is inserted into the sub guide groove 32A, the sub insertion portion 34*k* is hooked to the back surface 25*c* which is a surface at the back of the bottom surface 25*b* of the cassette, thereby preventing the edge guide 34A from falling out.

The main guide groove 27A is also provided with the widening portion 27*c* formed in a cassette side position. The side insertion portion 34*c* (FIG. 12) which is a portion of the edge guide 34A is inserted into the main guide groove 27A through the widening portion 27*c*. When the side insertion portion 34*c* is inserted into the main guide groove 27B, the side insertion portion 34*c* is hooked to the back surface 25*c* of the cassette, thereby preventing the edge guide 34A from falling out.

With respect to the side insertion portion 34*c*, the center insertion portion 34*e* is formed in the center in the sliding direction (x direction). The center insertion portion 34*e* is inserted into the main guide groove 27A along with the side insertion portion 34*c* and is hooked to the back surface 25*c* of the cassette, thereby preventing the edge guide 34A from falling out.

For this reason, hooking protrusions 34*d* and 34*f* are respectively formed so that the side insertion portion 34*c* and the center insertion portion 34*e* are larger than the groove width of the main guide groove 27A (width in the y direction).

When the side insertion portion 34*c* and the center insertion portion 34*e* are inserted into the main guide groove 27A, the hooking protrusions 34*d* and 34*f* are hooked to the back surface 25*c* of the cassette.

Here, the side insertion portion 34*c* is inserted into the main guide groove 27A through the widening portion 27*c* formed in the main guide groove 27A, but a widening portion for inserting the center insertion portion 34*e* into the main guide groove 27A is not formed. However, in this embodiment, efforts are made so that the center insertion portion 34*e* (and side insertion portion 34*c*) is easily inserted into the main guide groove 27A and does not easily fall out after insertion. Hereinafter, this will be described.

First, the widening portion 27*c* is provided with first protrusions 27*d* and 27*d* on both sides of the groove as illustrated in FIG. 9. The first protrusions 27*d* and 27*d* are configured so that a certain degree of resistance (catch) is generated when the side insertion portion 34*c* is inserted into the widening portion 27*c*.

On the other hand, with a predetermined gap from the main guide groove 27A in the y direction, the widening allowance groove 29A extending along the main guide groove 27A is formed.

The widening allowance groove 29A allows widening of the main guide groove 27A (groove width expansion in y direction). When the side insertion portion 34*c* and the center insertion portion 34*e* are inserted into the main guide groove 27A, a deformation rib 30A formed between the main guide groove 27A and the widening allowance groove 29A is easily deformed on the upper side in FIG. 9 by the widening allowance groove 29A, that is, the main guide groove 27A easily widens.

For this reason, when the side insertion portion 34*c* is inserted into the widening portion 27*c*, the hooking protrusion 34*d* of the side insertion portion 34*c* pushes the first protrusion 27*d* on the upper side in FIG. 9, the main guide groove 27A (widening portion 27*c*) temporarily widens, and thereby the side insertion portion 34*c* is completely put into the widening portion 27*c*.

The state at this time is illustrated in a change from FIG. 17A to FIG. 17B. In addition, the state is illustrated in a change from FIG. 10 to FIG. 11. The state of a portion of the widening portion 27*c* in which the first protrusion 27*d* is not formed is illustrated in a change from FIG. 16A to FIG. 16B.

Next, in a portion of the edge guide 34A into which the center insertion portion 34*e* is inserted, second protrusions 27*e* and 27*e* are formed as illustrated in FIG. 9. The groove widths of regions in which the second protrusions 27*e* and 27*e* are formed are the same as those of other regions as illustrated in FIG. 9. The upper face of the second protrusion 27*e* is configured as an inclined plane as illustrated in FIG. 18. With this, the hooking protrusion 34*f* of the center insertion portion 34*e* easily pushes the second protrusion 27*e* on the upper side in FIG. 9 (right side in FIG. 18), the main guide groove 27A temporarily widens, and thereby the center insertion portion 34*e* is completely inserted into the main guide groove 27A.

The state at this time is illustrated in a change from FIG. 18A to FIG. 18B. In addition, the state is illustrated in a change from FIG. 10 to FIG. 11.

A process of attaching the edge guide 34A to the sheet cassette 25 is, as described above, configured so that the edge guide 34A is first placed in the centermost position of the cassette (position in FIG. 5) and then the sub insertion portion 34*k* is inserted into the sub guide groove 32A through the widening portion 32*c*. Subsequently, the edge guide 34A is placed in the sidemost position of the cassette, and the side insertion portion 34*c* and the center insertion portion 34*e* are pushed into the main guide groove 27A.

As described above, since the widening allowance groove 29A which allows widening of the main guide groove 27A is formed with a predetermined distance from the main guide groove 27A in which the side insertion portion 34*c* and the center insertion portion 34*e*, which are portions of the edge guide 34A (insertion portion), are inserted, each of the insertion portions can be easily inserted into the main guide groove 27A. In addition, after insertion, the width of the main guide groove 27A returns to the original width, and thus it is possible to prevent each of the insertion portions, that is, the edge guide 34A from easily falling out. With this, the installation property of the edge guide 34A (34B as well) becomes favorable and the edge guide 34A (34B as well) becomes reliably held.

In addition, the widening allowance groove 29A is formed along the extending direction (x direction) of the main guide groove 27A so as to include the widening portion 27*c* formed in the main guide groove 27A. Thus, when the side insertion portion 34*c* is inserted, it is possible for the widening portion 27*c* to favorably widen and it is possible for the side insertion portion 34*c* to be easily inserted.

The widening allowance groove 29A corresponding to the edge guide 34A as the first edge guide and the widening allowance groove 29B corresponding to the edge guide 34B as the second edge guide are positioned between the main guide groove 27A with respect to the edge guide 34A and the main guide groove 27B with respect to the edge guide 34B in the sheet sending-out direction (y− direction) (refer to FIG. 8).

With this, when forming each widening allowance groove, it is not necessary to secure a large region for forming the widening allowance groove.

Subsequently, a closing unit which closes each widening allowance groove will be described. In the back surface 25*c* of the cassette, a cover member 40 is attached by a screw 41 (FIG. 6) as illustrated in FIGS. 4 and 6. The attached cover member 40 covers the rack and pinion mechanism provided in the back surface 25*c* of the cassette.

First, the rack and pinion mechanism will be described. The rack and pinion mechanism is configured to include the pinion gear 38 which is rotatably provided in the cassette center portion (center portion in width direction) as illustrated in FIG. 7 and rack members 36A and 36B which are arranged to pinch the pinion gear 38 in the y direction and engage with the pinion gear 38. Due to the rack and pinion mechanism, the edge guides 34A and 34B operate to be displaced in synchronization.

The rack member 36A is formed separately from the edge guide 34A, and the rack member 36B is also formed separately from the edge guide 34B. The edge guide 34A attached from the bottom surface 25*b* side of the cassette and the rack member 36A attached from the back surface 25*c* side are connected to the center insertion portion 34*e* which is inserted from the bottom surface side of the cassette to the back surface and protrudes on the back surface side. A concave portion formed in the center insertion portion 34*e* (represented by sign 34*g* in FIG. 13) is a rack joint portion into which a convex portion formed in the rack member 36A (represented by sign 36*c* in FIG. 7) is inserted.

Since the rack member 36A (and 36B) and the edge guide 34A (and 34B) are connected in a state of being separately configured as described above, the installation property is enhanced compared to a configuration in which the rack member and the edge guide are integrally formed. That is, in the configuration in which the rack member and the edge guide are integrally formed, it is required to insert the rack member from the bottom surface side to the back surface side of the cassette, and thus the installation becomes complicated. On the contrary, since the rack member and the edge guide can be joined on the cassette back surface side with being separately formed, the installation is enhanced.

The rack and pinion mechanism configured in this manner is covered and protected by the cover member 40. Protrusions 40*a* and 40*b* are formed in the cover member 40 as illustrated in FIG. 14. When the cover member 40 is attached to the cassette, the protrusions 40*a* and 40*b* are inserted into the widening allowance grooves 29A and 29B, respectively, and close the widening allowance grooves 29A and 29B.

FIG. 15 illustrates a state in which the protrusion 40*b* is inserted into the widening allowance groove 29B. The protrusion 40*b* is formed to close the entirety of the widening allowance groove 29B in the length direction in the embodiment. Similarly, although not illustrated, the protrusion 40*a* is also formed to close the entirety of the widening allowance groove 29A in the length direction. The change from FIG. 16B to FIG. 16C, the change from FIG. 17B to FIG. 17C, and the change from FIG. 18B to FIG. 18C illustrate aspects in which the widening allowance groove 29A is closed by the protrusion 40*a*.

According to the aspect of the invention, since there is provided the closing unit (protrusions 40*a* and 40*b*) which closes the widening allowance grooves 29A and 29B, in the edge guide 34A, for example, after inserting the center insertion portion 34*e* and the side insertion portion 34*c* which are portions thereof (insertion portion) into the main guide groove 27A, it becomes difficult for the main guide groove 27A to widen. That is, it is difficult for the center insertion portion 34*e* and the side insertion portion 34*c* to fall out from the main guide groove 27A, and thus it is possible to more reliably hold the edge guide 34A.

In addition, in the embodiment, since the protrusions 40*a* and 40*b* which configure the closing unit are formed in the cover member 40, it is possible to simplify the structure of the closing unit, thereby configuring the closing unit at a low cost.

In the embodiment, the protrusions 40*a* and 40*b* are configured to close the entirety of the widening allowance grooves 29A and 29B in the length direction, respectively, but not limited to this. A configuration may be employed in which at least a portion is closed and accordingly the widening of each main guide groove is regulated.

Subsequently, other characteristics of the sheet cassette 25 will be described mainly referring to FIG. 19 and the subsequent drawings.

First, the mounting structure of the sheet cassette 25 with respect to the apparatus main body 2 of the printer 1 will be described. Signs 46*a* and 46*b* in FIG. 19 represent side walls formed in a main body frame 46 that forms the apparatus main body 2. The sheet cassette 25 is guided by the side walls 46*a* and 46*b* in an attaching-detaching direction (vertical direction in FIG. 19).

Sign 48 represents a cam capable of rotating around a shaft 48*a* in a clockwise direction and a counter-clockwise direction in FIG. 19. The cam 48 is urged by a spring (not shown) in the clockwise direction in FIG. 19. When the sheet cassette 25 is mounted, the cam 48 presses the sheet cassette 25 to the side wall 46*b*. Accordingly, the position of the sheet cassette 25 in the x direction is regulated in the mounting state.

In addition, signs 46*c* and 46*c* in FIG. 19 represent stoppers formed in the main body frame 46. The stopper 46*c* functions in the following manner.

First, when the sheet cassette 25 is detached from the apparatus main body 2, a step 25*k* formed in the bottom surface 25*c* of the sheet cassette 25 is caught in the stopper 46*c* as illustrated in FIG. 20. Therefore, in order to withdraw the sheet cassette 25 in this state, the sheet cassette 25 is slightly lifted and then withdrawn.

Since the step 25*k* is caught in the stopper 46*c* when the cassette is withdrawn in this manner, it is possible to prevent the cassette from unintentionally sliding in an instant, thereby falling out.

Subsequently, a first spacer 42 is provided at the back of the sheet cassette 25 as illustrated in FIG. 22. Main functions of the first spacer 42 will be described later, but a guidance slope 42*a* and a regulated surface 42*b* are formed in the first spacer 42. The regulated surface 42*b* is a perpendicular surface formed along the attaching-detaching direction of the sheet cassette 25.

When the sheet cassette 25 is mounted, the guidance slope 42*a* engages with the stopper 46*c* on the left side in FIG. 19 and the regulated surface 42*b* guides a left hand anterior horn portion (horn portion provided with first spacer 42: FIG. 22) of the sheet cassette 25 in a form of coming into contact with the stopper 46*c*.

On the other hand, a rib 25*m* protruding to the side wall 46*b* side is formed in the front of the left side surface of the sheet cassette 25 (FIG. 21). In a mounting state of the sheet cassette 25 as illustrated in FIG. 21, the regulated surface 42*b* and the stopper 46*c* come into contact with each other and the rib 25*m* and the side wall 46*b* come into contact with each other. With this, the position of the front (y+ side) of the sheet cassette 25 in the x direction is accurately regulated. Further, the position of the back (y− side) of the sheet cassette 25 in the x direction is, as described above, accurately regulated by the pressing of the cam 48.

Subsequently, the first spacer 42 and the second spacer 44 will be described. The sign 26*n* in FIG. 3 represents a holding portion when the sheet cassette 25 is held. In the holding portion 26*n*, fine irregularities are formed to obtain a favorable grip property. The swing shaft 25*f* of the hopper 4 is formed in the inner side of the cassette which is a region in which the holding portion 26*n* is formed. The swing shaft 25*f* is integrally formed with respect to the cassette main body 25*a* formed of a resin material.

On the inner side of the wall surface on which the swing shaft 25*f* is formed, a space 25*h* is formed as illustrated in FIG. 25A. By means of the space 25*h*, the swing shaft 25*f* can be retracted to the space 25*h* side in accordance with the elastic deformation of the wall surface on which the swing shaft 25*f* is formed. In addition, an inclined plane 25*g* is formed on the upper surface of the swing shaft 25*f*. Therefore, when fitting the shaft engaging portion 4*a* of the hopper 4 to the swing shaft 25*f*, if the hopper 4 is pushed from above to the sheet cassette 25 as it is, the hopper 4 is not caught in the swing shaft 25*f* and the hopper 4 causes the swing shaft 25*f* to be retracted in the left direction in FIG. 25A. Thus, it is possible to facilitate workability and to fit the shaft engaging portion 4*a* to the swing shaft 25*f*.

Here, the space 25*h* is formed at the back of the cassette, and a space 25*j* is formed at the opposite side thereof (FIG. 24). The spaces 25*h* and 25*j* are positioned below the holding portions 26*n* and 26*n* illustrated in FIG. 3. Therefore, the spaces 25*h* and 25*j* are disadvantageous from the viewpoint of a holding property. In addition, although the spaces 25*h* and 25*j* are advantageous from the viewpoint of an installation property of the hopper 4, after installation, the hopper 4 becomes easy to fall out due to the easiness of the retraction of the swing shaft 25*f*.

Accordingly, the first spacer 42 is inserted into the space 25*h* and the second spacer 44 is inserted into the space 25*j* as illustrated in FIG. 24. With this, for example, the space 25*h* comes to a state of being buried by the first spacer 42 as clearly illustrated in FIG. 25B, and thus a holding property when holding the holding portion 26*n* is enhanced. In addition, since the retraction of the swing shaft 25*f* is regulated, it is possible to prevent the attached hopper 4 from easily falling out.

Respective configuration elements described hereinabove may be appropriately modified, to say nothing of those which are not limited to the described content.

In particular, in the embodiment, an example in which the medium mounting mechanism according to the invention is applied to a sheet cassette of an ink jet printer, which is an example of a recording apparatus, is described. However, the invention is not limited thereto and may be applicable to edge guides provided in various apparatuses, such as an auto sheet feeder provided in the rear portion of an apparatus, a sheet feed tray provided in the rear portion or the front portion of an apparatus, and an auto document feeder which automatically transports a document in an image reading apparatus exemplified by a scanner.

The entire disclosure of Japanese Patent Application No. 2013-196561, filed Sep. 24, 2013 is expressly incorporated by reference herein.

What is claimed is:

1. A medium mounting mechanism comprising:

a main body which forms a medium mounting surface for mounting a medium;

an edge guide which guides an edge of the medium mounted on the main body, and is slidable to a position corresponding to a size of the medium;

a guide groove which extends along a sliding direction of the edge guide and guides the edge guide in the sliding direction, and into which a portion of the edge guide is inserted; and a widening allowance groove which is provided with a predetermined distance from the guide groove, and allows widening of the guide groove when a portion of the edge guide is inserted into the guide groove, wherein the edge guide includes a first edge guide which guides an edge on one side of the medium and a second edge guide which guides an edge on the other side of the medium in a medium width direction intersecting with a medium sending-out direction, wherein a protrusion which closes at least a portion of the widening allowance groove is provided in a cover member provided in a back surface which is a surface opposite to a bottom surface of an accommodating region in the main body, and wherein the cover member is attached to the main body and thereby covers a rack and pinion mechanism which is provided in the back surface and operates the first edge guide and the second edge guide in an interlocking manner.

2. The medium mounting mechanism according to claim 1, wherein the guide groove includes a widening portion for insertion of a portion of the edge guide formed to be wider than the guide groove, and wherein the widening allowance groove is formed along an extending direction of the guide groove, in the form of including the widening portion in the extending direction of the guide groove.

3. The medium mounting mechanism according to claim 1, wherein, in the medium sending-out direction, the widening allowance groove with respect to the first edge guide and the widening allowance groove with respect to the second edge guide are positioned between the guide groove with respect to the first edge guide and the guide groove with respect to the second edge guide.

4. The medium mounting mechanism according to claim 1, wherein the rack and pinion mechanism includes a rack connected to each of the first edge guide and the second edge guide, and a pinion gear engaging with the rack.

5. A recording apparatus comprising:

a recording unit which performs recording on a medium; and the medium mounting mechanism according to claim 1.

* * * * *